US009586735B2

(12) United States Patent
Jensen

(10) Patent No.: US 9,586,735 B2
(45) Date of Patent: Mar. 7, 2017

(54) COVER FOR OPENING AND CLOSING CANS

(71) Applicant: Michael Keigan Jensen, Palma de Mallorca (ES)

(72) Inventor: Michael Keigan Jensen, Palma de Mallorca (ES)

( * ) Notice: Subject to any disclaimer, the term of this patent is extended or adjusted under 35 U.S.C. 154(b) by 0 days.

(21) Appl. No.: 14/603,529

(22) Filed: Jan. 23, 2015

(65) Prior Publication Data

US 2015/0298874 A1 Oct. 22, 2015

Related U.S. Application Data

(62) Division of application No. 13/497,547, filed as application No. PCT/EP2010/000906 on Feb. 11, 2010, now abandoned.

(30) Foreign Application Priority Data

Feb. 11, 2009 (DE) ..... 10 2009 008 395

(51) Int. Cl.

| | |
|---|---|
| ***B65D 51/18*** | (2006.01) |
| ***B65D 47/26*** | (2006.01) |
| ***B65D 8/00*** | (2006.01) |
| ***A47G 19/22*** | (2006.01) |
| ***B65D 85/72*** | (2006.01) |

(52) U.S. Cl.

CPC ..... *B65D 47/265* (2013.01); *A47G 19/2205* (2013.01); *B65D 7/04* (2013.01); *B65D 47/26* (2013.01); *B65D 85/72* (2013.01)

(58) Field of Classification Search

CPC ..... B65D 47/265; B65D 17/166; B65D 2517/0044; B65D 17/165; B65D 2251/0025; B65D 2251/0071

USPC ..... 220/253

See application file for complete search history.

(56) References Cited

U.S. PATENT DOCUMENTS

| | | | | |
|---|---|---|---|---|
| 2,961,133 A | | 11/1960 | Ankney | |
| 4,127,212 A | | 11/1978 | Waterbury | |
| 4,880,136 A | * | 11/1989 | Englert | B65D 17/165 220/253 |
| 5,205,430 A | | 4/1993 | Valyi | |
| 5,692,633 A | * | 12/1997 | Gordon | B65D 47/265 220/253 |

(Continued)

FOREIGN PATENT DOCUMENTS

| | | |
|---|---|---|
| DE | 196 43 487 A1 | 3/1998 |
| FR | 2 820 407 | 8/2002 |

(Continued)

OTHER PUBLICATIONS

PCT Search Report, May 31, 2010.

*Primary Examiner* — Shawn M Braden
(74) *Attorney, Agent, or Firm* — Dority & Manning, P.A.

(57) ABSTRACT

The invention relates to a cover for opening and closing cans, in particular beverage cans, having a top circular cover component and a bottom cover component. By moving the two cover components relative to one another, at least one through-hole can be opened and re-closed by both cover components. A highly effective seal is obtained by precise coordination of the form of the top and bottom cover components, which can be increased even further by the additional use of sealing materials such as varnish, rubber, plastic or welded connections.

19 Claims, 39 Drawing Sheets

(56) References Cited

U.S. PATENT DOCUMENTS

| | | | | |
|---|---|---|---|---|
| 6,158,608 | A * | 12/2000 | Schlattl | B65D 17/166 220/253 |
| 6,216,904 | B1 * | 4/2001 | Cagan | B65D 47/265 220/253 |
| 6,428,261 | B1 | 8/2002 | Zysset | |
| 6,910,598 | B2 * | 6/2005 | Gotz | B65D 17/18 220/258.3 |
| 7,165,696 | B2 | 1/2007 | Neiner | |
| 2004/0140237 | A1 * | 7/2004 | Brownewell | B21D 51/26 206/503 |
| 2004/0188440 | A1 * | 9/2004 | Schlattl | B65D 17/165 220/253 |
| 2006/0283839 | A1 * | 12/2006 | Saito | B24B 37/26 216/84 |
| 2007/0145055 | A1 * | 6/2007 | Gardiner | B65D 17/166 220/254.4 |

FOREIGN PATENT DOCUMENTS

| | | |
|---|---|---|
| GB | 1141246 | 1/1969 |
| GB | 1389351 | 4/1975 |
| WO | WO 01/89737 A1 | 11/2001 |

* cited by examiner

361

371

COVER FOR OPENING AND CLOSING CANS

RELATED APPLICATION

The present application is a Divisional Application of U.S. application Ser. No. 13/497,547, filed Mar. 22, 2012, which application is a 371 International Application of PCT/EP2010/000906, filed Feb. 11, 2010.

FIELD OF THE INVENTION

The invention refers to a cover for opening and closing cans, especially beverage cans.

BACKGROUND

There are many drawing can covers with opening systems known from the state of the art. Generally, the beverage cans used nowadays have a stay-on tab with a rivet-fastened, ring-shaped metallic cover plate that is pressed towards the interior of the can, following the slitting line marked on the oval area of the cover. This opening system for drinking has the disadvantage that it cannot be closed once again after it has been opened.

A possibility of attaching a re-closable cover would be to join it to the top edge of the can. Such an embodiment has been described in DE 69809567T2, for example. However, the top edge of the can is attached during the filling process, leading to the following problems: The product spills out while the cover is being attached, the spilled-out liquid must be removed, a second cover must be immediately attached so filling speed is not affected and costs increase. In addition, attachment to the top edge of the can is difficult because the tolerance values are not sufficiently low and there can be up to 0.3 mm difference between two covers. An attachment to the top edge of the can would also lead to changed packaging modifications and transportation capability owing to the different piling height. This would lead to higher planning modification expenses for fewer products per volume.

SUMMARY

An objective of this invention is the further improvement of known opening systems for beverage cans. Additional objects and advantages of the invention will be set forth in part in the following description, or may be obvious from the description, or may be learned through practice of the invention.

The main objective of this invention is to consider, as far as possible, all current production standards and criteria. In particular, high cost effectiveness is pursued, followed by marked production delimitation. The fewer modifications that are needed in current standards, the larger the possible savings. To accomplish this objective, it is essential to implement all changes in one spot of the production line (either in production or in the filling station). In this case, the improved approach centers on the production step, as it is carried out less often and can be better implemented owing to existing technical resources.

Therefore, the filling step is completely ruled out as possible means of improvement in this invention. An exception to this rule would be an "add-on" design feature not functionally essential and merely optional for the customer.

According to an initial aspect of the invention, the task of improving current opening systems for drinking cans is solved by a cover for the opening and closing of cans, especially beverage cans, that features a top circular cover component and a bottom cover component. By moving the cover components relative to one another, at least a through-hole can be achieved, re-closable by moving the cover components relative to one another. This makes it not only possible to open a can that was once opened, but to securely close it again.

It is especially advantageous for the top cover component to be attached to the inner area of the bottom cover component. Attaching the drinking closure system on the interior surface of the bottom cover component instead of on its outer edge has the advantage that the cover can be entirely produced in an upstream step and then be merely attached to the body of the can in one step after filling.

The bottom cover component can have at least one opening, which can already be there or made only after moving the cover components towards one another. In this way, an opening for allowing the liquid to flow out and another one for ventilation purposes can be provided.

The opening and closing movement of the cover components relative to one another can be achieved by pivoting the top cover component on the bottom cover component. However, a lateral displacement is also conceivable.

It is especially advantageous to create a joint on the bottom cover component and to use it for attaching the top cover component. In a rotatable mounting, the bottom cover component can have a circular movement groove on its surface. In this case, the radius of the groove is smaller than the radius of the bottom cover component and the top cover component has a spring that snaps and/or clicks in place into the fastening groove.

Here, the invention falls back on folding mechanisms for can covers known from the state of the art. A possibility for bending such a joint is described in WO 01/897 37 A1. It describes how a safety fold can be bent in several steps in a can cover. Other ways for bending such a joint can also be employed. Another method is described in the published U.S. application Ser. No. 09/578,044, which also describes how a can cover can be bent to a safety fold in several steps. Other methods known to the expert can also be used for folding the joint.

At the same time, there are other possibilities from the state of the art, as well as turning flanging and edge rolling that can be utilized to create the fastening joint on the bottom cover. Placing this fastening joint inside the bottom cover makes it possible to separate the critical features of the filling design from the production of the cover. The additional manufacture of the fastening joint also facilitates the attachment to the top cover by a hook, thus creating an optimal functional design and not depending on the edge flange results.

Thanks to the positioning on the bottom cover component, the top cover component is protected from possible dropping damage by the top external edge of the can. The top cover component is located below the edge of the can, and is thereby no longer exposed. In addition, less material is needed for the top cover component by attaching it to the bottom cover component in a fastening joint with a radius within the outer edge of the can. Weight-wise, this feature makes this invention comparable to stay-on tab versions.

In addition to the material and cost savings, further improvements are possible owing to system compatibility. Current production speeds make it possible to classify the covers mechanically and join them with the bottom cover component. This can be done by employing the identical technology and method as is already being used in standard stay-on tab technology for attaching the loop or ring. The current design of the elevations on the bottom cover is similar to the anti-rotation tip used for classifying the stay-on tab for the ring. The top cover component would be attached in the same step in which the ring or loop is placed in the stay-on tab system.

The standard folding technology used for the loop or ring can also be employed for shaping the bends of the top cover component. These bends also serve as cover strengthening, as compensation for the material that is missing on the sides and at the same time as mechanism for opening the closure.

Additionally, the folded structure of the top cover component has the following advantages with regard to the spilled-over liquid: The folded shape makes it easier to reach the surface of the bottom cover component and also easier to clean spilled-over liquid at the filling station. Also, condensation of the liquid after pasteurization can dry up quite well.

It is advantageous for the bottom cover component to have an elevation that acts together with the corresponding design of the top cover component. It can be shaped in any way—for example, cylindrical or pyramidal. The top cover component can have either a respective elevation or a recess that corresponds to the shape for mounting the cover components. In addition, the element can also maintain the cover components separate.

The top cover component can be made of aluminum, but the use of tinplate or plastic is also conceivable.

In the plastic version, it is possible to remove the top component slightly so the plastic can be recycled. Since the bottom cover component is larger than the top cover component made of plastic, the product keeps flowing across the bottom cover, keeping the liquid cold and separated from the top cover. Furthermore, in case a plastic version is used, the feeling of drinking from a "cold can" does not get lost, as the edge of the can still touches the mouth.

It is additionally possible to use tinplate because no open metal ending touches the product on the top cover component, thereby preventing rust and contamination. With the stay-on tab tinplate system, it is customary to re-paint pressure-formed parts as additional protection. This can also be done for the opening of the bottom cover component, if necessary. Owing to its price and general application advantages in the market, tinplate is a particularly suitable material. In this case, the smallest material thickness used as standard (0.16 mm) is sufficient. Due to the smaller radius of the top cover component, this is innately stiffer, making an even thinner tinplate diameter of 0.12 mm possible.

According to a further aspect of the invention, the top cover component can have a recess so less material is used for it. At the same time, the recess can serve as an opening in the top cover component. The top cover component, in particular, can have a recess shaped like a circular segment—even two recesses shaped like a circular segment and arranged opposite one another are conceivable.

The opening inner edge can be angled. This applies both to an opening in the bottom cover component and to an opening in the top cover component. As a result of the angle, a sealing can take place when the top cover component interlocks with the bottom one.

Alternatively or cumulatively, a sealing can also be arranged between the cover components. In this regard, a sealing is understood to be any medium suitable for attaching the two cover components. Thus, a coat of paint is conceivable as a form of sealing, but rubber, plastic or suitable liquid media such as adhesives and even welding are possible. In this context, the sealing can be designed so it fits tightly in place in the opening of the bottom cover component. Finally, it can also interlock with the top cover component.

The sealing must be able to resist numerous stresses, like vibrations during transportation, pressure changes, and changes in the contact area caused by thermal expansions during temperature changes. The manufacture of a sealing ring is therefore very costly, both during development and production. Since this can lead to a considerable production slowdown and make the sealing considerably more expensive to manufacture, the aim should be to accomplish the sealing with other media.

Another aspect of the invention foresees the top and bottom cover components to be made from a hybrid coating material with a plastic layer. It is advantageous for the plastic layer of the bottom cover component to be placed on that of the top cover component, between the two of them.

The utilization of such a hybrid layered composite material consisting of one-half plastic and one-half tinplate or aluminum, for example, makes it possible to combine the advantages of the various materials in different areas so they have a favorable effect on the general performance features.

If the plastic side is processed while on top on the bottom cover, and on the bottom on the top cover, then the two plastic sides will have direct contact. The conical opening in the bottom cover component forms a good sealing surface contact with the conical projection of the top cover component. This contact area is subsequently joined with heat or high-frequency welding. In this case, the welding focuses on the surroundings of this area and is utilized only for an instant after the second cover is assembled. Later, the user breaks through this welded part by pressing inward the hood-shaped structure on the top cover component, destroying the welded sealing in the process. The top cover component can now be turned. This can also be accomplished by an instantaneous loss of pressure that evens out the two cover surfaces, facilitating the slight turning of the top cover component.

In a plastic version, the seal would be designed as part of the top cover component. A projection on the top cover component would then have the identical negative shape of the top part of the opening of the bottom cover component. This arching on the top cover component is joined snugly with the hole on the bottom cover component with which it will be later welded to by pressing into a tear line on the inner side. The seal-less plastic version is opened in the same way as the version with a seal.

With regard to the opening and closing possibilities, it is conceivable to integrate a snap closure in the top cover of the metallic version. To achieve this, it is conceivable to provide an arching in the middle of the top cover so that the side of the top cover that is folded upward snaps downward, thereby closing—but not sealing—the can. In order to seal the can, the folded lateral components are then pressed inward in this closed position and the cover locks in place in a sealed position. When the cover is re-opened, the arching snaps out and locks in place in the open position.

Another aspect of the invention refers to a method for manufacturing a cover. Here, the top cover and the bottom cover are manufactured separately and subsequently joined in a downstream step.

A final aspect of the invention refers to a method for joining a cover with a bottom cover component. In this case, the pre-manufactured cover is joined to the can in a downstream step. Thus, the filling section of the production line is left unchanged and the current filling speed is maintained.

BRIEF DESCRIPTION OF THE DRAWINGS

The invention will now be discussed in greater detail with the help of numerous embodiments depicted in the drawings, which show.

DESCRIPTION

Figure 1:
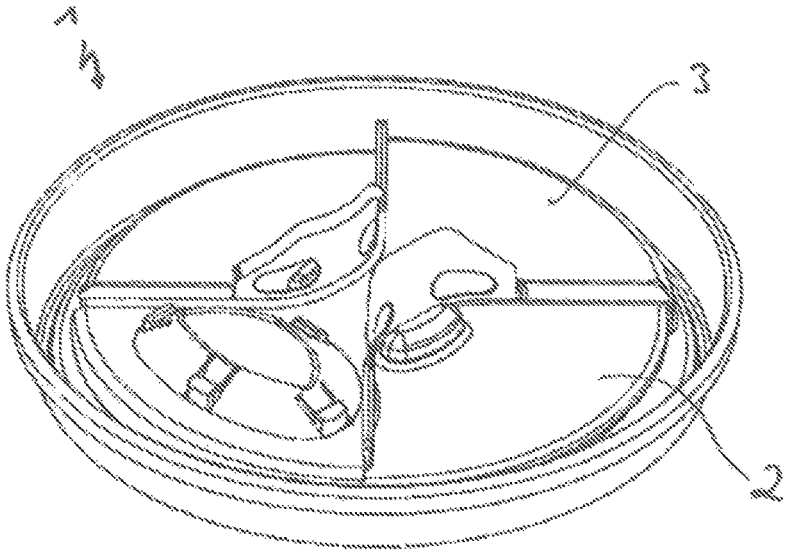
FIG. 1 is a three-dimensional view of the cover made of aluminum.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

The cover 1 made of aluminum shown in FIG. 1 consists of a bottom cover component 2 and a top cover component 3.

Figure 2:
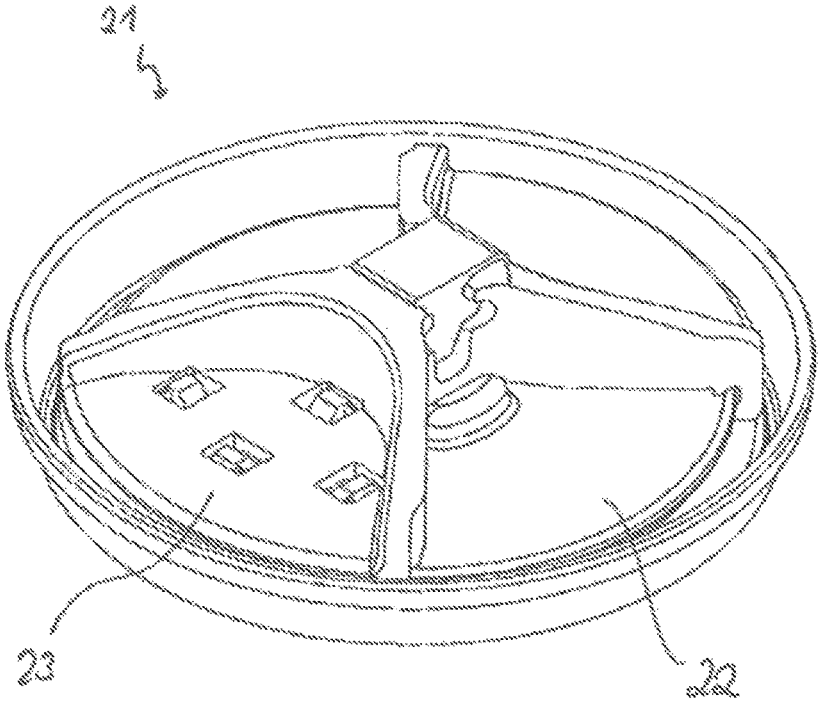
FIG. 2 is a three-dimensional view of the cover made of plastic.

FIG. 2 shows a cover 21 partly made of plastic with a bottom cover component 22 made of aluminum and a top cover component 23 made of plastic.

Figure 3:
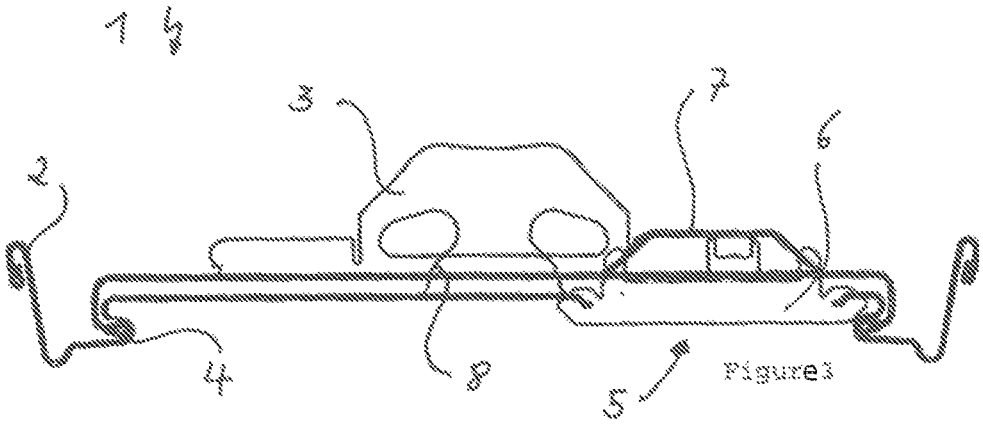
FIG. 3 is a section view through a cover made of aluminum.

FIG. 3 shows a section through the cover 1 made of aluminum of FIG. 1 with the bottom cover component 2 and the top cover component 3. The top cover component 3 engages in a fastening joint 4 located in the bottom cover component 2. Here, a seal 6 closes the opening 5, but it can be broken through by exerting pressure on the elevation 7. The top cover component 3 is pivoted on the elevation 8 in the bottom cover component 2.

Figure 4:
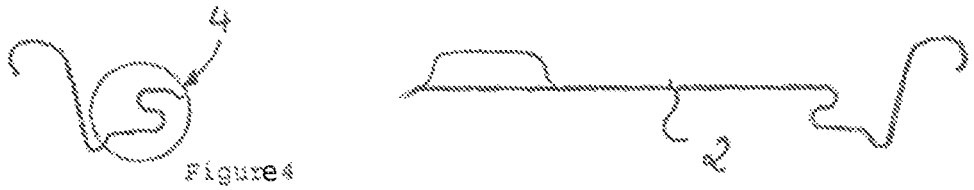
FIG. 4 is a section view through the bottom cover component with marked fastening joint.

FIG. 4 shows the bottom cover component 2 with the fastening joint 4 marked.

The utilization of the so-called "safety fold-end" technology or of another folding technique known by the expert makes it possible to displace the fastening joint 4 for the top cover component (not shown) from the outer edge of the can towards the interior. This has the advantage of making an intervention in the filling process unnecessary because the second cover component (not shown here) can already be mounted in the production step. The mounting of the second cover component is similar to the steps necessary for joining the ring with the cover in stay-on tab closures.

Figure 5:
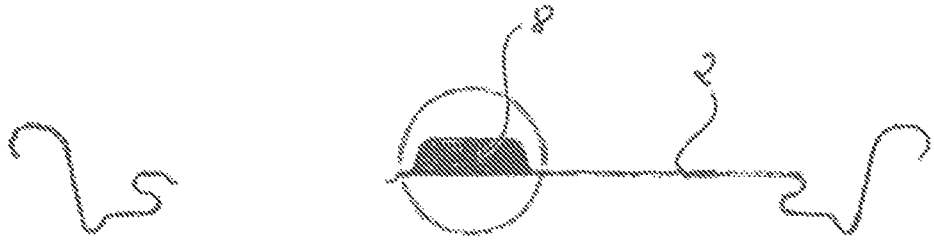
FIG. 5 is a section view through a bottom cover component with marked elevations.

FIG. 5 emphasizes the elevation 8 for mounting located in the bottom cover component.

The elevation 8 pointing upward allows a better alignment of the covers. It could also be used as an ordering aid for the bottom cover 2 if the latter must be aligned.

Figure 6:
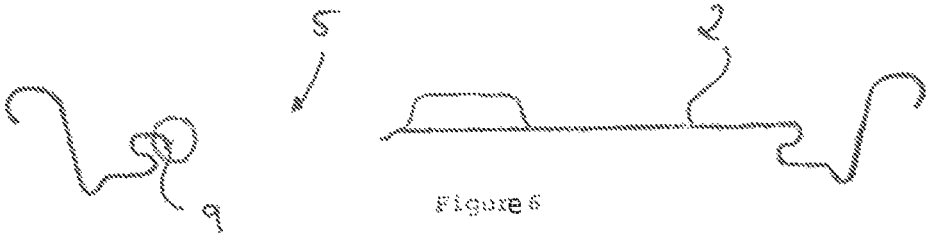
FIG. 6 is a section view through a bottom cover component with marked opening area.

In FIG. 6, the opening area towards the opening 5 in the bottom cover is marked. An angled wing 9 located there allows a larger sealing surface on a more restricted space by taking advantage of the vertical length. This design allows a possible minimization of pressure loss caused by the thermal expansion of the material when aluminum or plastic is used, for example. An angled surface also makes more sealing surface available and serves as an inner ring for increasing sealing effectiveness.

Figure 7:
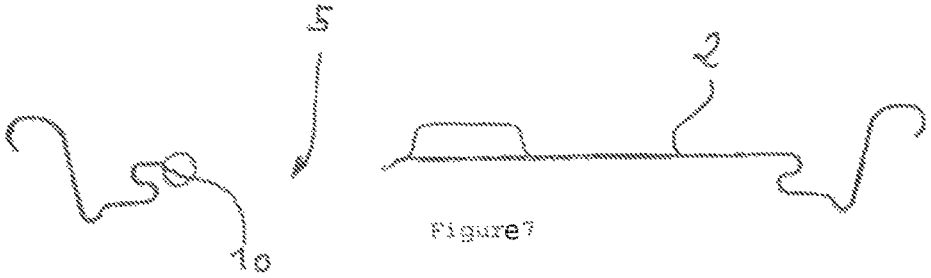
FIG. 7 is a section view through a bottom cover component with marked cutting edge on the opening.

In the bottom cover component 2 shown in FIG. 7, the cutting edge 10 in the opening 5 is marked. A flattened cut on this cutting edge 10 allows keeping the seal in place because the cut offers resistance when the seal is pressed, thereby preventing the seal to slide downward. The flattened cut 10 also allows a precise size adjustment necessary for the good fit of the seal.

Figure 8:
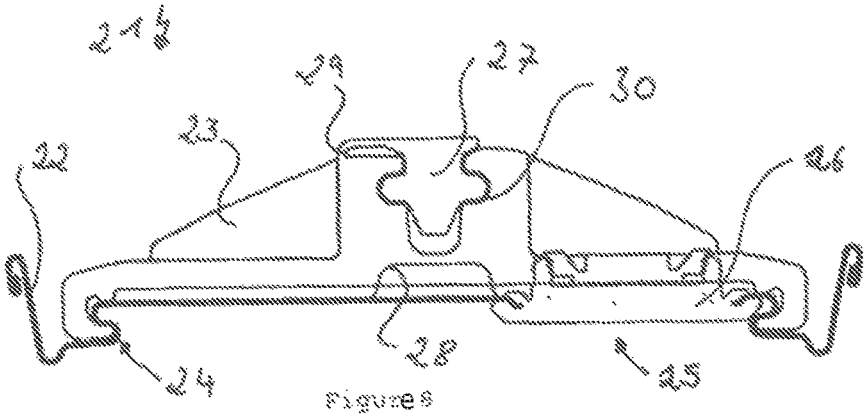
FIG. 8 is a section view through a cover with a top cover component made of plastic.

FIG. 8 shows a cross section through a can cover 21 with a bottom cover component 22 made of aluminum and a top cover component 23 made of plastic. Here, the top cover component 23 also engages in a fastening joint 24. A seal 26 has been arranged in the opening for drinking 25. Here, too, mounting is achieved by the elevation 28 in the bottom cover component, but an opening of the seal takes place here by pressing the T-shaped engagement component 27 inward. After use, the top cover component 23 can be easily removed when the T-shaped engagement component 27 is cut off from the fastening joint 29 and then pushed out of the lead 30. Then it is possible to press the top cover component 23 together to unhook and remove it.

Figure 9:
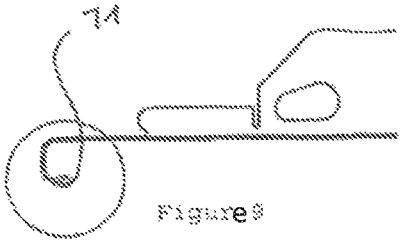
FIG. 9 is a view of the hook of a top cover component made of aluminum.
Figure 10:
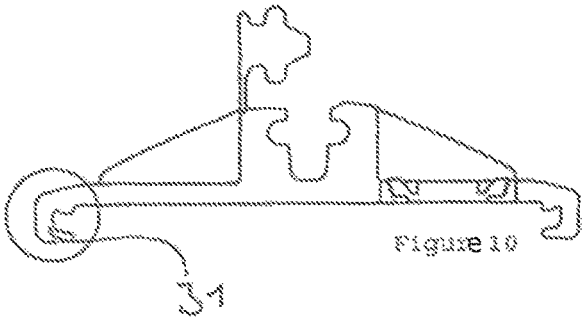
FIG. 10 is a view of the hook of a top cover component made of plastic.

Both in the design of the top cover component 3 made of aluminum shown in FIG. 9 and in the design of the top cover component 23 made of plastic shown in FIG. 10, it is in each case possible to manufacture the hook 11 and 31 according to function because the mounting possibilities no longer have to be adapted to the shape of the edge rim of the edge of the can after attaching the cover. This is especially important when the surface of the hook 11 and 31, respectively, is reduced as this invention suggests.

It is also possible to manufacture the top cover component with a double hook for strengthening the mounting of the second cover component. In this case, a second fastening groove could be attached on the top side of the bottom cover component for this second hook. Even a triple spring in the top cover component is conceivable for further strengthening the mounting of the second cover component. FIG. 31 shows this structural variant and others in detail below.

Figure 11:
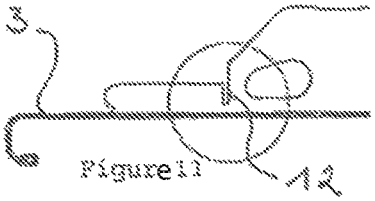
FIG. 11 is a view of the target expansion points of a top cover component of an aluminum cover.
Figure 12:
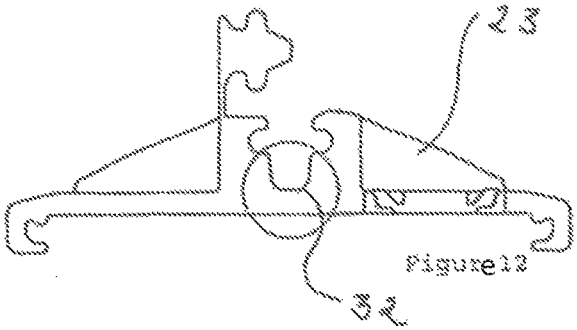
FIG. 12 is a view of the target expansion points of a top cover component of a plastic cover.

The top cover component 3 or 23 made of aluminum in FIG. 11 and made of plastic in FIG. 12 can have cuts 12 or areas 32 with fewer materials in certain spots in order to eliminate excessive stiffness that can prevent the top cover component 3 or 32 from fitting successfully together with the bottom cover. Here, the cuts 12 or areas 32 with fewer materials can be arranged in such a way that the stress relief acts only in one direction for preventing the unhooking of the top cover component 3, 23.

Figure 13:
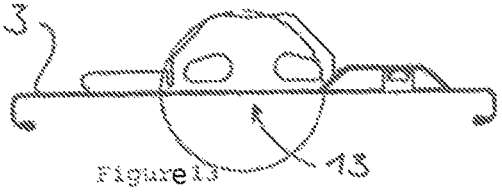
FIG. 13 is a view of the middle area of an aluminum cover.
Figure 14:
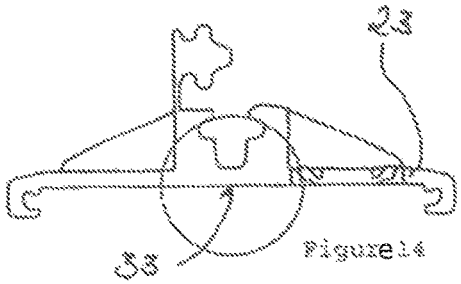
FIG. 14 is a view of the middle area of a plastic cover.

The top cover component 3 or 23 made of aluminum (FIG. 13) or plastic (FIG. 14) has a rounded section in the marked middle area 13 or 33 that allows the top cover component 3, 23 to easily slide above the elevation 8 (cf. FIG. 5).

Figure 15:
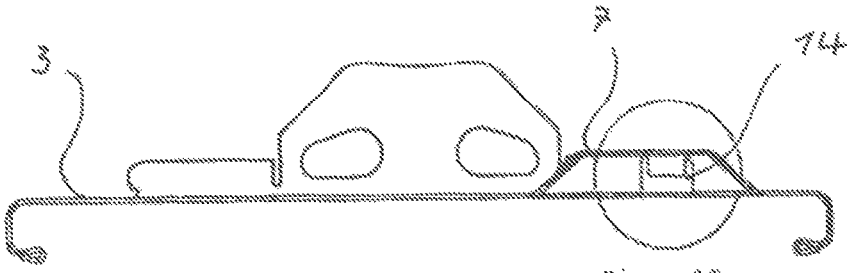
FIG. 15 is a section view through an aluminum cover with marked opening area.

The top cover component 3 shown in FIG. 15—with cuts 14 on the elevation 7—is the aluminum version. These cuts create a tong shape that will later engage in a grooved tab on the seal. As a result of this, it would be joined with the top cover component 3 while the cover is being put together during production. So that the user can open it later, the hood 7 is pressed inward, leading to the opening of the seal along a predetermined tear line.

Figure 16:
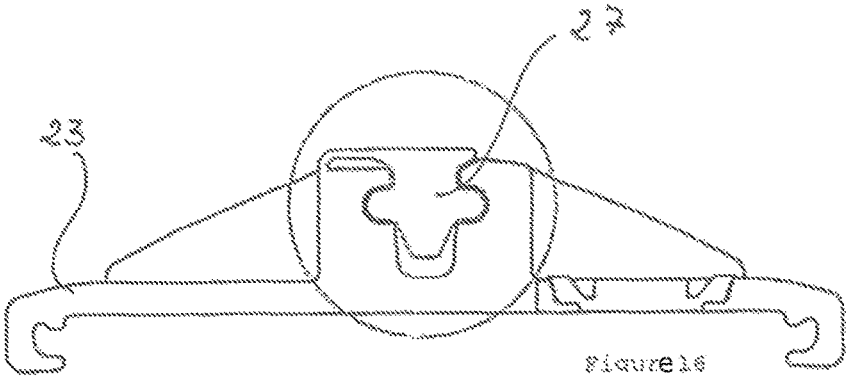
FIG. 16 is a section view through a plastic cover with marked opening area.

FIG. 16 shows a variant of the cover 23 made of plastic. It is equipped with a similar mechanism so it engages with the seal, with the exception of the projection that the seal of the metallic version has. This allows the direct placement of the cover on the seal when the former is attached in the production line. In this case, the top plastic cover 23 is mounted with the open snapper 27 (shown closed here), thus making it possible to bend the cover and facilitating the mounting in the production line. If the end user engages the snapper 27 to open the can (as shown here), the cover will jump upward during the engaging process and weaken the seal so it can be torn open. If this does not tear it open, then it can surely be accomplished by turning the top cover component 23.

Figure 17:
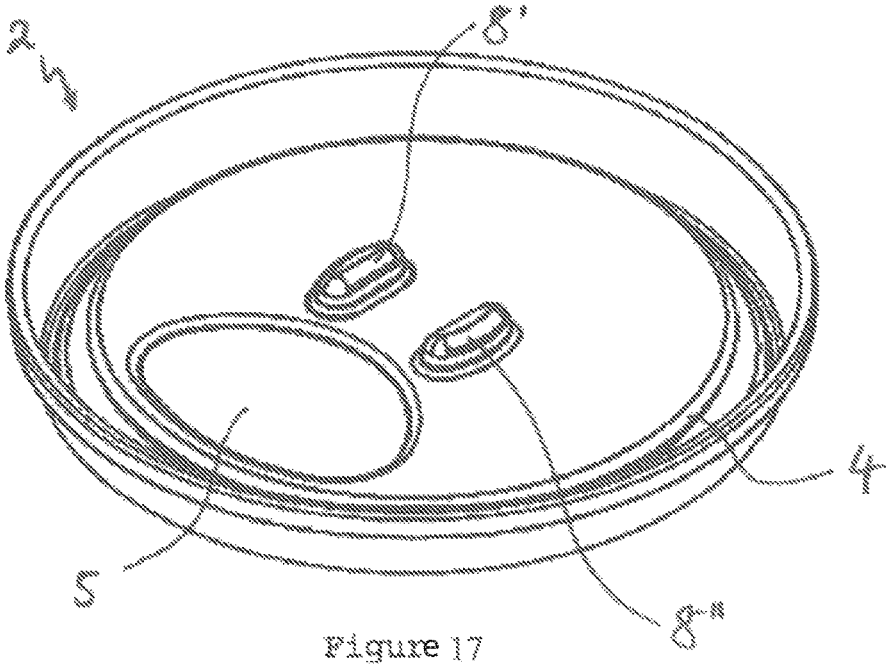
FIG. 17 is a three-dimensional view of a bottom cover component.

The bottom cover component 2 shown in FIG. 17 can be utilized both for the aluminum version of the cover 1 and for the plastic version of the cover 21 (cf. FIGS. 1 and 2). It has the fastening joint 4 (or 24), the opening for drinking 5 as well as two elevations 8 and 8" for mounting the top cover component.

Figure 18:
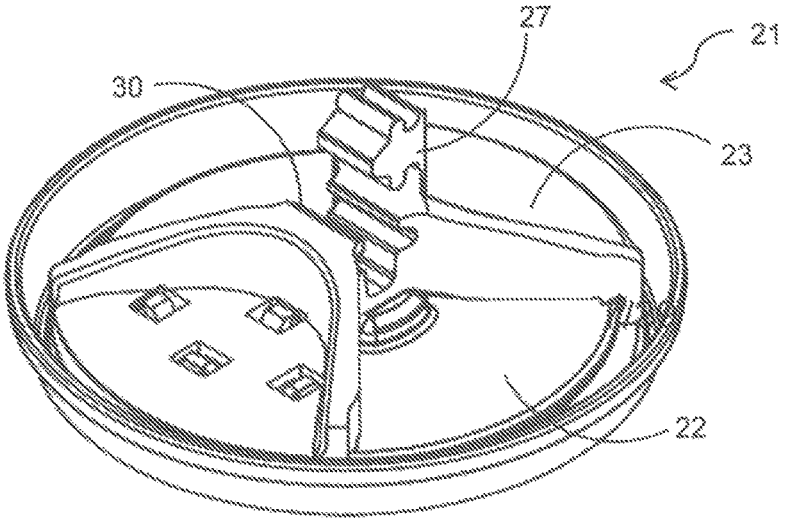
FIG. 18 is a three-dimensional view of the cover with a top cover component made of plastic in an unopened state.
Figure 19:
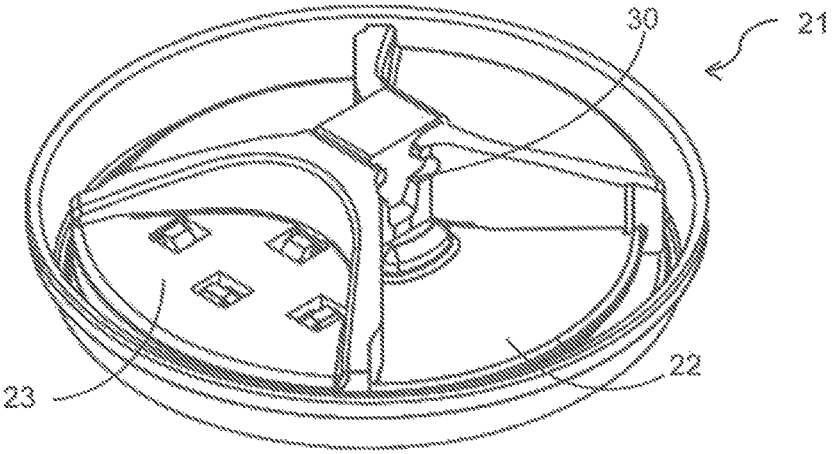
FIG. 19 is a three-dimensional view of the cover with a top cover component made of plastic in an unsealed, but unopened state.
Figure 20:
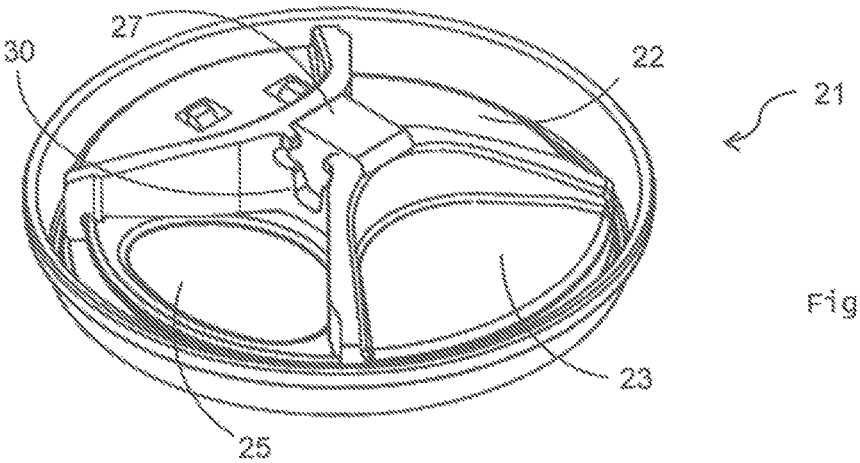
FIG. 20 is a three-dimensional view of the cover with a top cover component made of plastic in an opened state.
Figure 21:
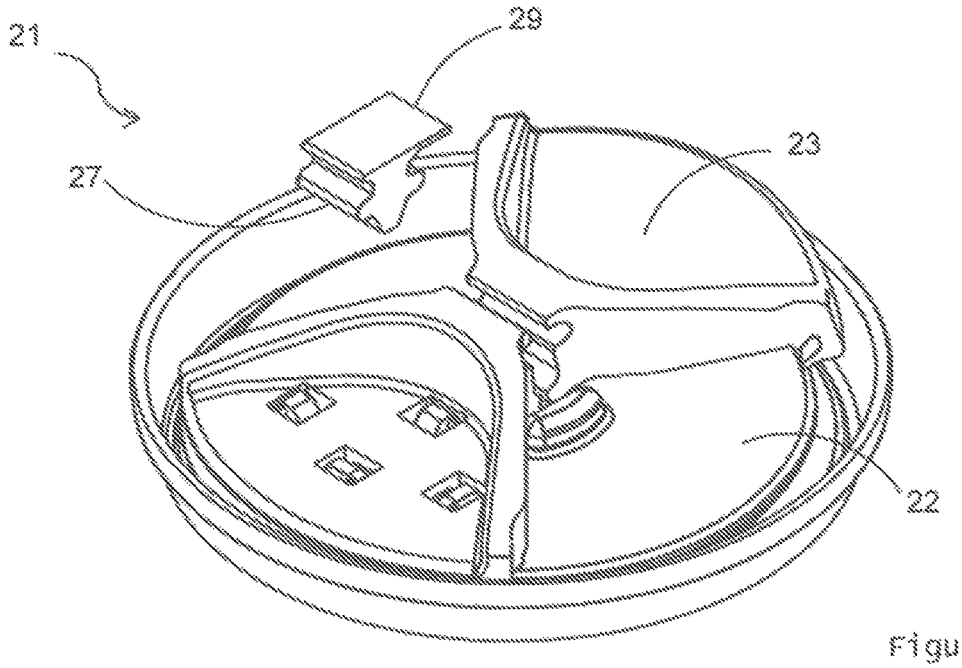
FIG. 21 is a three-dimensional view of the cover with a top cover component made of plastic, in a state opened for recycling.

In FIG. 18, a top cover component 23 made of plastic has been placed on the bottom cover component 22 so that both of them together build the cover 21. If the cover 21 should be opened, the engagement component 27 is pressed into the guide 30 to tear open the seal. Now the top cover component 23 can be turned on the bottom cover component 22 and the opening 25 is exposed, as shown in FIG. 20. After the can is used, the engagement component 27 can be removed by separating the tab 29 so the top cover component 23 can be completely detached from the bottom cover component 22.

Figure 22:
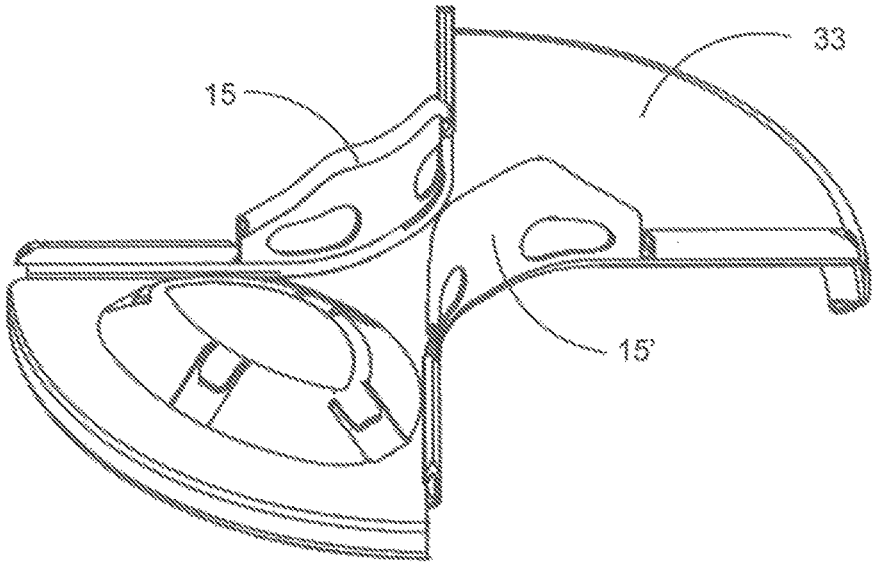
FIG. 22 is a three-dimensional view of a top cover component made of aluminum.

Likewise, the top cover component 3 made of aluminum shown in FIG. 22 can be placed on top of the bottom cover component 2 shown in FIG. 17. Even this one can afterwards be turned on the bottom cover component 3 after the seal has been broken through. The wings 15 and 15' provide a gripping surface for this purpose.

Figure 23:
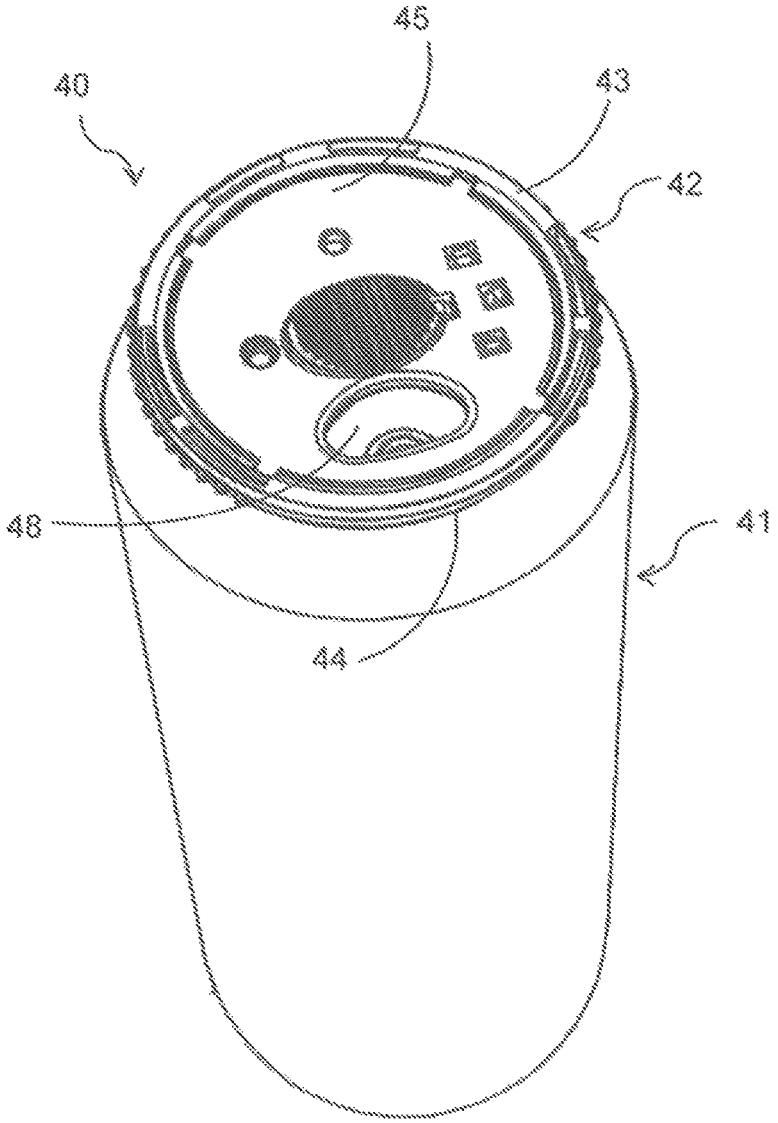
FIG. 23 is a three-dimensional view of a can with an "add-on" design feature with a two-part top plastic cover component.
Figure 24:
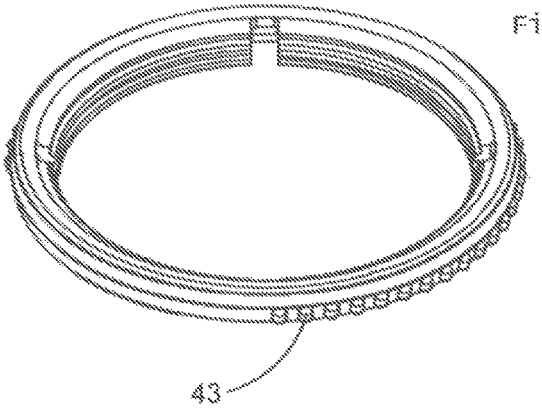
FIG. 24 is a three-dimensional view of the outer edge section of the plastic cover component.
Figure 26:
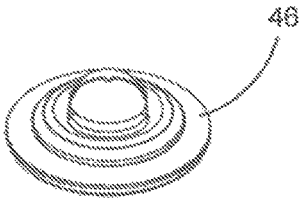
FIG. 26 is a three-dimensional view of a small seal.
Figure 25:
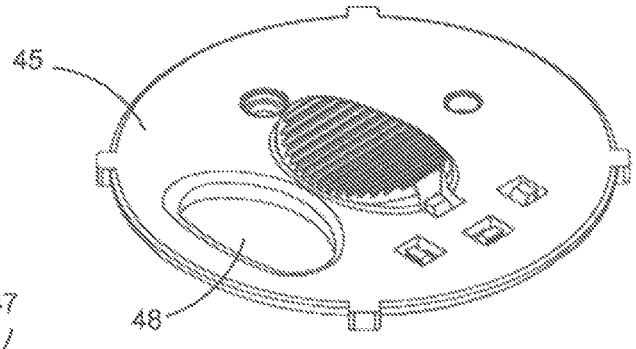
FIG. 25 is a three-dimensional view of the inner edge section of the plastic cover component.
Figure 27:
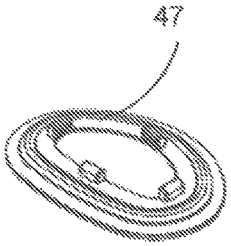
FIG. 27 is a three-dimensional view of a large seal.
Figure 28:
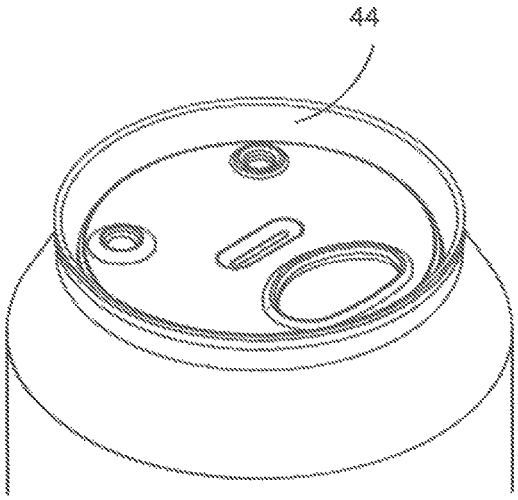
FIG. 28 is a three-dimensional view of the bottom cover component of the can with opened seals.

FIG. 23 shows a complete can 40 consisting of a can body 41 with a two-part top plastic cover 42—an "add-on" design feature that also makes changes in the filling step necessary. In the course of this, an outer plastic ring 43 (see also FIG. 24 for a detailed image) is mounted onto the top can edge 44 (see FIG. 28). An inner cover component 45 (see also FIG. 25 for a detailed image) that covers the top can cover from above can then be pressed inward in the plastic ring 43 around the can edge 44. The inner plastic part 45 engages in the inner side of the outer can edge. At the same time, possible seals 46, 47 (cf. FIGS. 26 and 27) engage in the cover component 45 and are permanently joined to it. Also simultaneously, the seals are broken through around the opening of the cover 48 by a sharp edge. To accomplish this, the seals 46, 47 are designed with a predetermined breaking spot to facilitate the process. Now the can 40 can be used. If it is turned by 90°, it opens, if it is turned back, it closes again. This cover design allows rivets and a clear visual indicator as soon as the cover was opened once.

Based on the same engagement principle, the top cover component can be designed as one single component. The top cover component would be engaged in the seal in the filling station and fixed in place there until turning tears it open. This would also serve as a tamper-proof mechanism. This version can be used with both plastic and aluminum materials.

In a further execution—the "break-open design"—the functional spot is located directly above the spot that should be opened. Here, the functional spot of the cover that has been mounted above the seal is a component separated by the cover. This component is small compared to the opening's proportions. The form is pressed inward for breaking the seal, which engages in the component, and the latter engages in a lower recess in the cover.

A further embodiment has an arching above the opening. Here, the material is so thin that the thumb can press the arching inward, thereby connecting the seal with insertion openings in the arching. The pushing-in of the arching opens the seal and at the same time serves as tamper proof. This design variant can also be utilized with both materials (plastic and aluminum).

Figure 29:
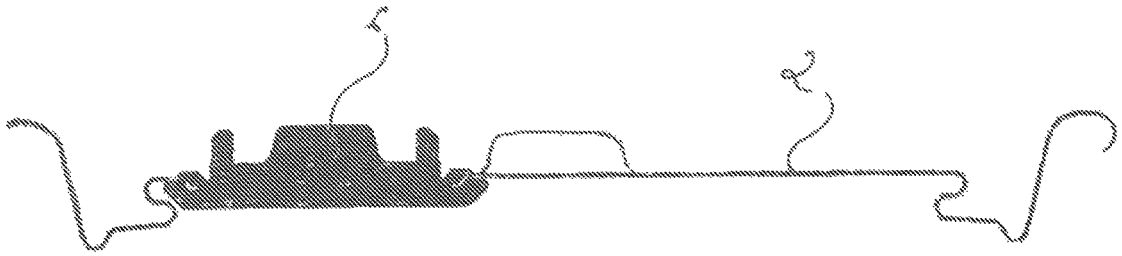
FIG. 29 is a section view through a bottom cover component made of aluminum with a seal.
Figure 30:
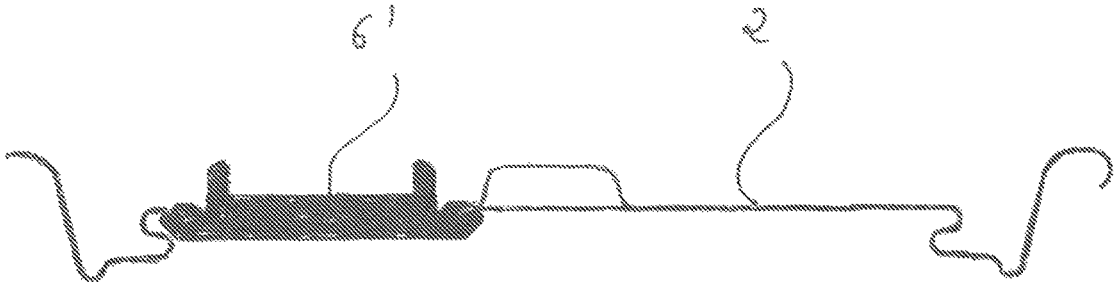
FIG. 30 is a section view through a bottom cover component made of aluminum with a seal.

The bottom cover component 2 of FIGS. 29 and 30 has in each case a seal (shown here in the different variants 6 and 6').

Figure 31A:
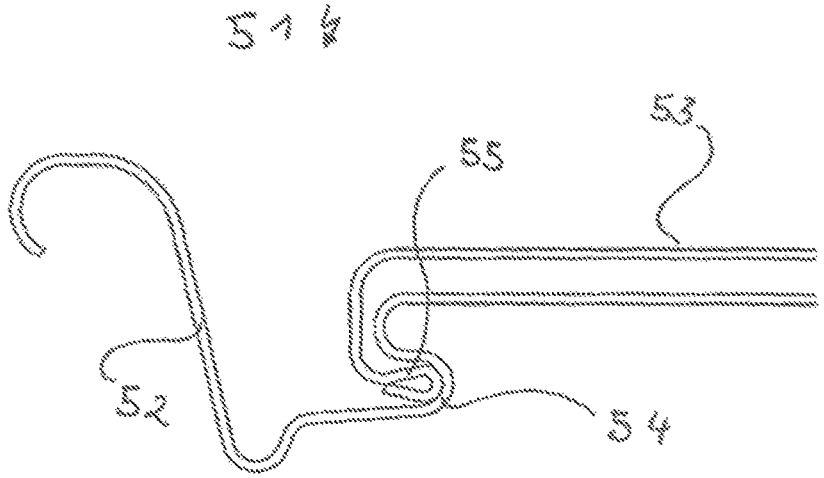
FIGS. 31*a* through 31*h* are views of possible designs of the connecting point between top cover component and bottom cover component.
Figure 31B:
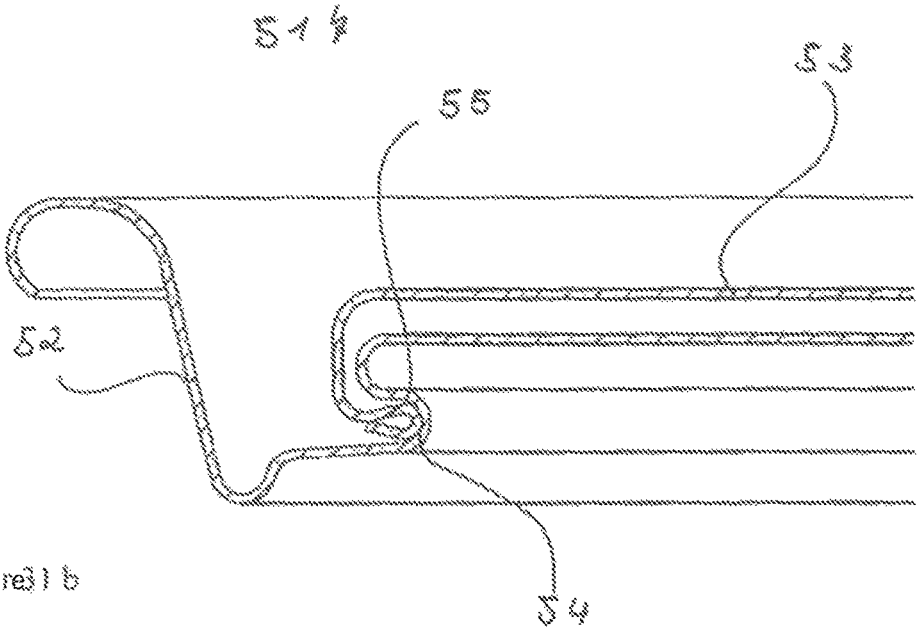

The can cover 51 in FIG. 31*a* consists of a bottom cover component 52 and a top cover component 53. Here, the bottom cover component 52 corresponds to a standard can cover with a fastening joint 54 that engages in a hook 55 of the top cover component 53. The hook 55 of the top cover component 53 has been folded for increased stability. This also improves the turning of the hook 55 in the joint 54. In FIG. 31*b*, the same cover 51 is once again shown three-dimensionally.

Figure 31C:
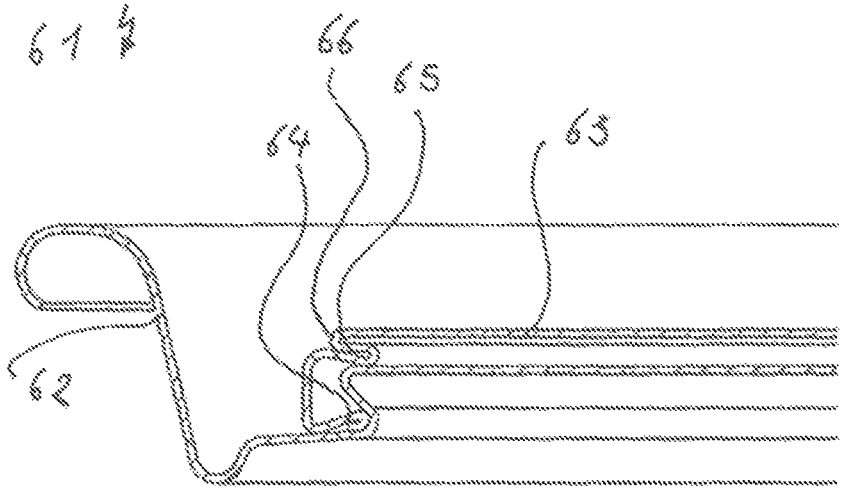

The can cover 61 in FIG. 31*c* consists once again of a bottom cover component 62 that corresponds to the normal can cover and of a top cover component 63. This time, however, a second hook 65 on the top cover component 63 has been provided beside the first hook 64 in order to improve the mounting of the top cover component 63. The bending on the outer edge 66 allows a more flexible movement in this area. This can be helpful because this area is stiffer owing to the proximity to further structures on the top cover component 63.

Figure 31D:
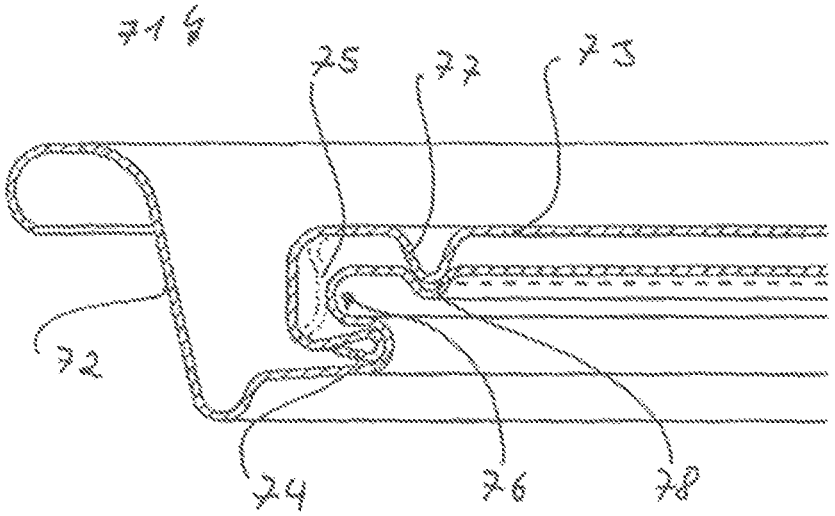

In the structural variant of a can cover 71 shown in FIG. 31*d*, the top cover component 73 has beside the hook 74 a lateral indentation 75, which is in contact with the fastening joint 76 of the bottom cover component 72 in order to prevent a lateral slipping out of position of the top cover component 73. Additionally, the top cover component 73 has a groove 77 that creates another fastening connection point. The former plus an additional groove 78 act together on the bottom cover component 72. The grooves 77 and 78 serve as guiding rail for mounting and lifting the top cover component 73 if they are not continuously mounted on the entire circumference.

Figure 31E:
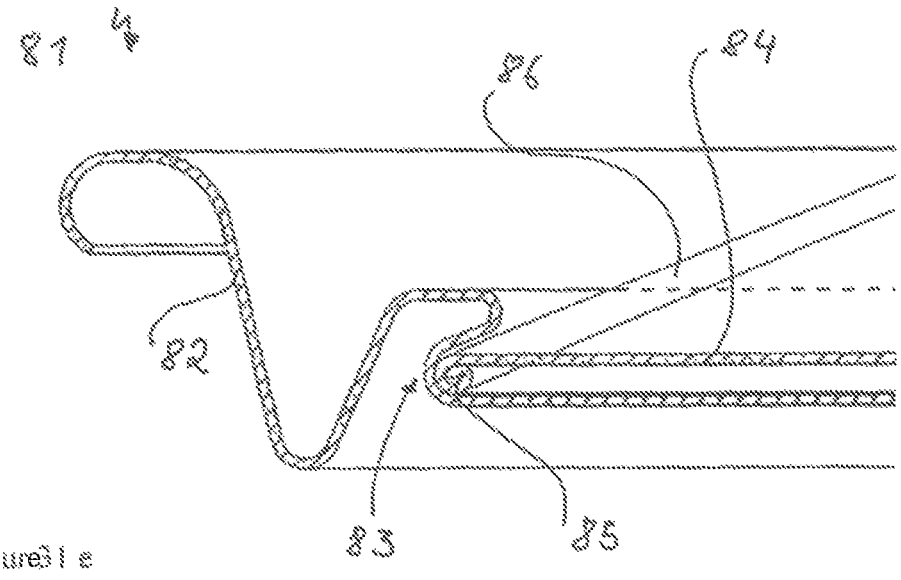

In FIG. 31*e*, the bottom cover component 82 of the cover 81 has a fastening joint 83 oriented inward that acts like a hook. The edge of the top cover component 84 is flat and has a roll edge 85 for making frictionless turning possible. Furthermore, it has a V-shaped opening 86 that acts as a spring. If the V-shaped opening 86 is pressed together with the index finger and thumb, the radius of the top cover component 84 becomes smaller, making an easy turning possible. With the smaller radius of the top cover component 84, it moves upward along the fastening joint 83.

Figure 31F:
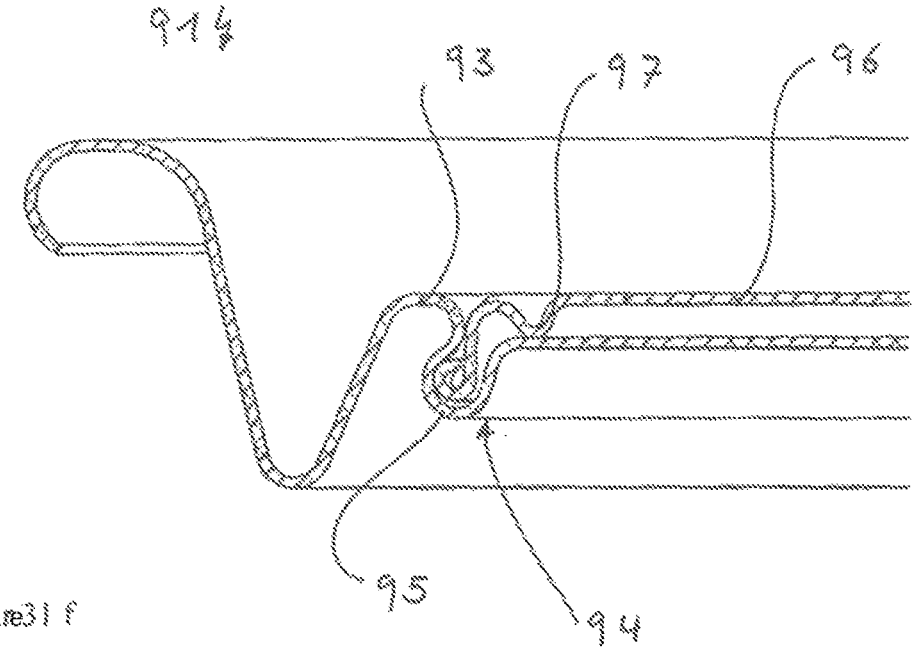

In the structural variant shown in FIG. 31*f*, the bottom cover component of the can cover 91 has—as fastening joint 94—a flange 93 pointing inward with a groove 95 that serves as guide for the top cover component 96. The groove 97 on the top cover component 96 increases stiffness and creates a constant separation between the cover components in order to prevent a blockage when the top cover component 96 is turned.

Figure 31G:
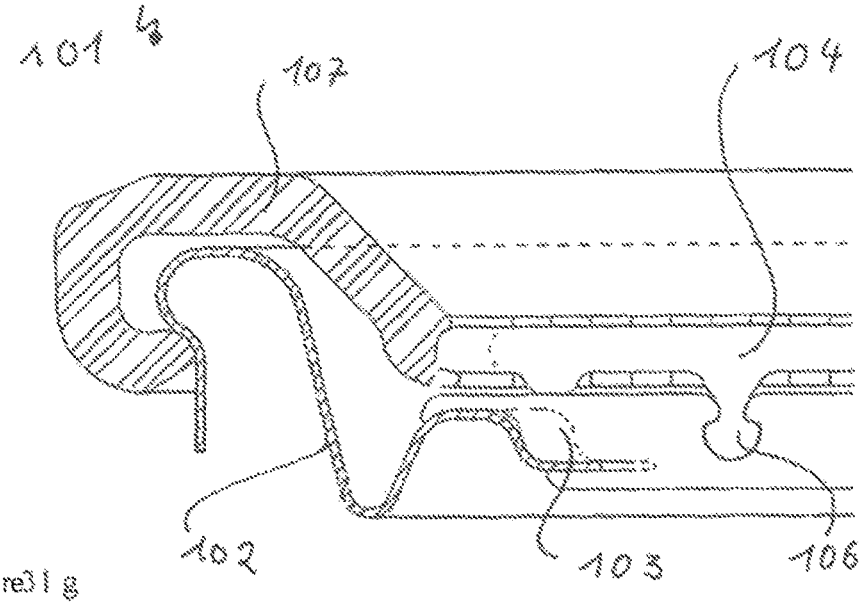

In the cover component 101 of FIG. 31*g*, the bottom cover component 102 has a fluted form 103 on which two inner plastic cover components 104 represent the functional elements and engage in the bottom cover component 102. The toothed form 103 of the bottom cover component 102 prevents the slipping out of position of the cover on the connecting surface. The toothing arrangement as far as possible below the top cover component 105 allows mounting without previous orientation because there is always only a small gap to the next engaging position. The two inner cover components have been provided with a snap-on device 106 that can be executed in various ways depending on the shape and needs. If it extends along the radius, it can also serve as guiding rail with varying height for accomplishing a lifting of the inner top cover component 104. In addition to the mounting of the two inner cover components, the engagement device can serve as safety seal that is broken through when the cover is turned. The second top cover component 107 merely serves to make a better gripping surface available for turning. However, it is not essential for functioning, as all functional components are located on both inner cover components.

Figure 31H:
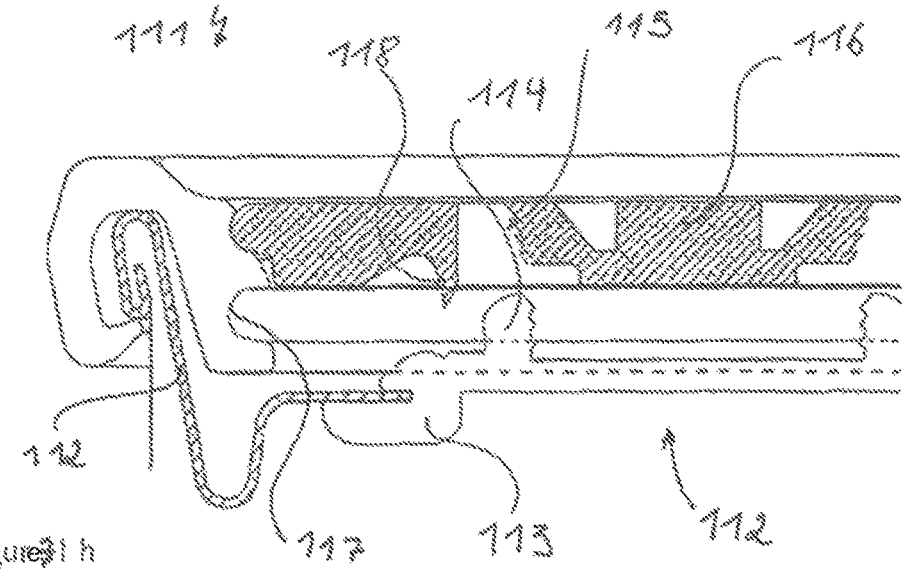

In the structural variant of a can cover 111 shown in FIG. 31*h*, the bottom cover component 112 is closed by a plastic shape 113 that engages in the opening of the bottom cover component 112. The seal 113 has some toothed tabs 114 that engage in a hook 11 (likewise toothed) on the inner cover component 116. The inner top cover component 116 engages on the top cover 116 in the top position. If it is oriented with the opening of the bottom cover component 112, the inner top cover component 116 is pressed inward to a second (lower) position and engages in the recess 117. In this case, the seal engages in the inner top cover component and is torn or cut in by the cutting device 118.

Figure 32A:
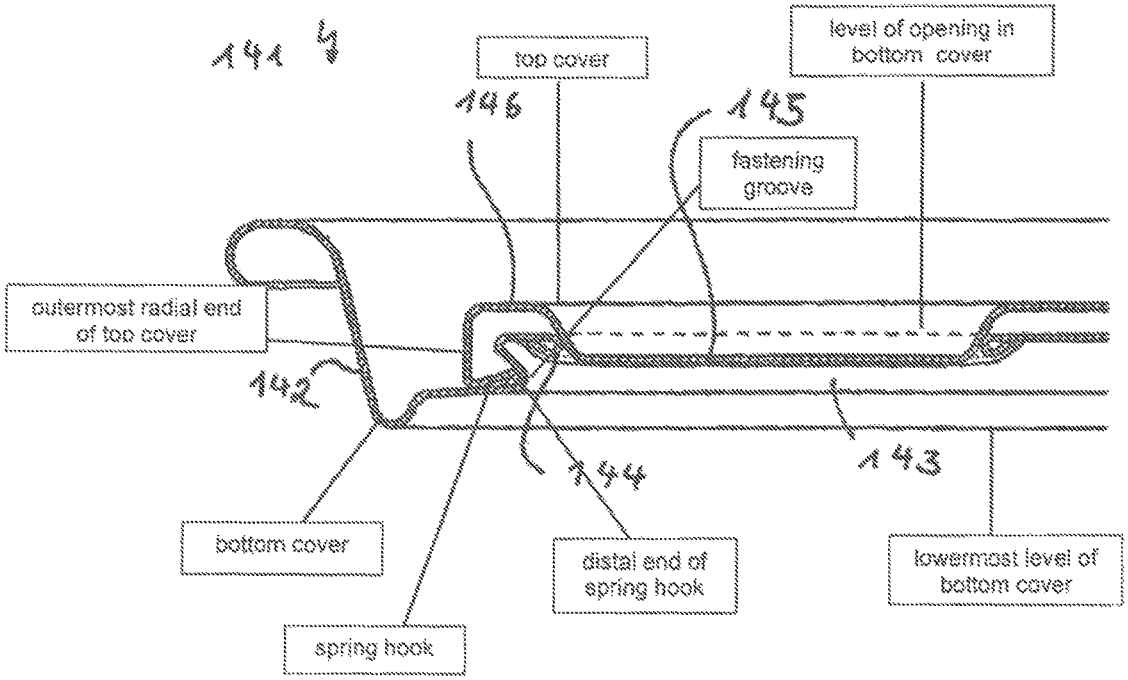
FIGS. 32*a* through 32*s* are views of possible designs of the sealing mechanism in the opening for drinking between top cover component and bottom cover component.

In the variant of a can cover 141 shown in FIG. 32*a*, the bottom cover component 142 has an opening 143 whose edges 144 are folded inward. With the cone 145 on the top cover component, these rounded edges 144 create a close contact to achieve a sealing. The sealing is interrupted when the top cover component 146 is turned. Until opening by the user, the edge on top of the cone creates a complete sealing.

Figure 32B:
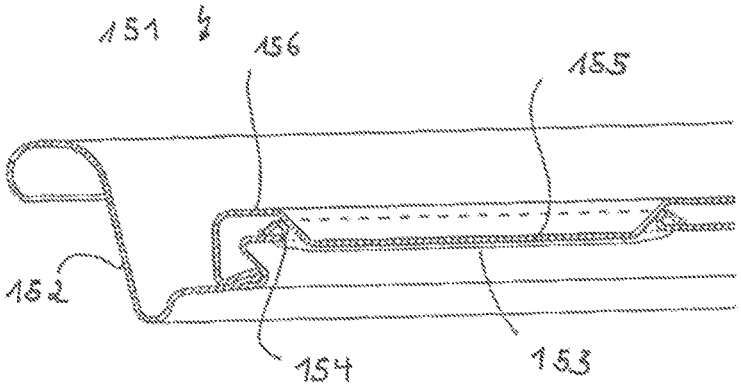

In the structural variant of a can cover 151 shown in FIG. 32*b*, the bottom cover component 152 has an opening 153 with an edge 154 folded upward. This can be advantageous for preventing the liquid in the can to make contact with the open cutting edge of the metal. Together with the tight fit of the cone 155 on the top cover component 156, a gastight sealing is achieved until the break occurs.

Figure 32C:
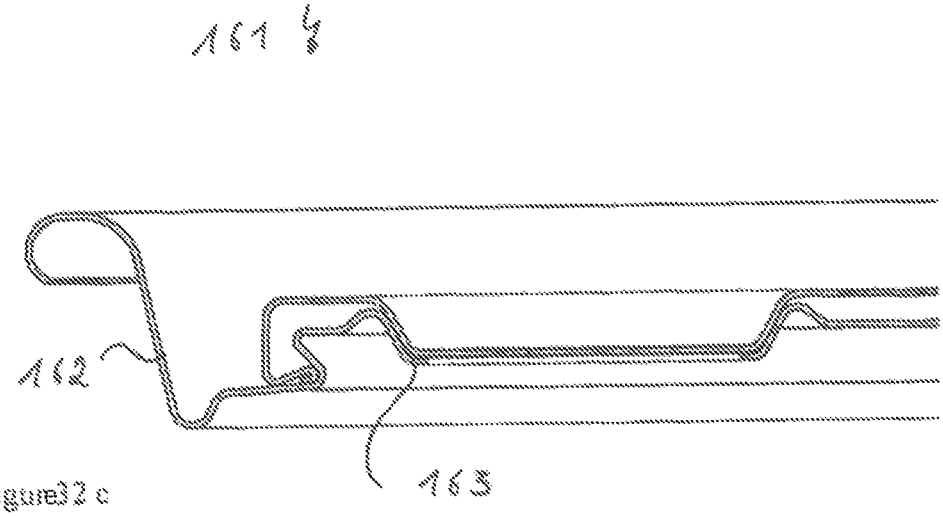

In the structural variant of a can cover 161 shown in FIG. 32*c*, the bottom cover component 162 has a fold 163 for enhancing the stiffness of this area and at the same time for increasing the sealing surface. A sealing can be achieved by using a remaining plastic layer composite, which is attached in the contact area by thermal or high-frequency welding.

Figure 32D:
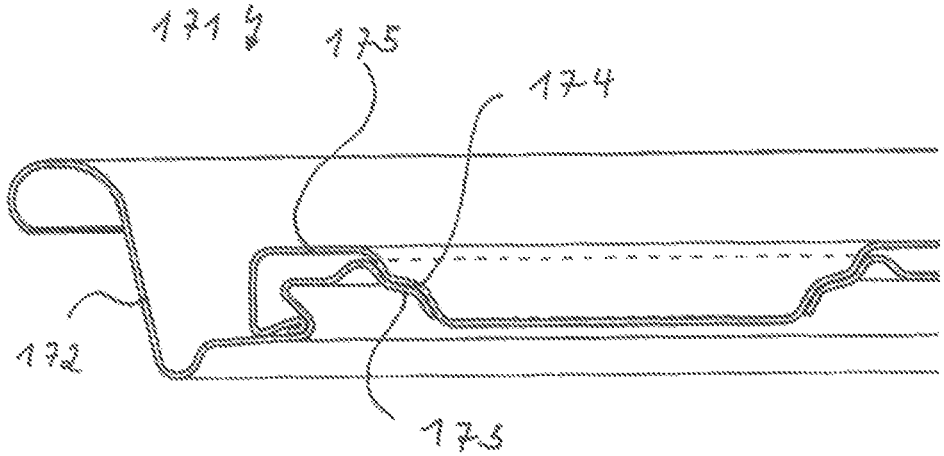

A double fold 173 on the bottom cover component 172 creates an expansion of the sealing surface in the top cover component 175 with a double cone 174 (cf. FIG. 32*d*).

Figure 32E:
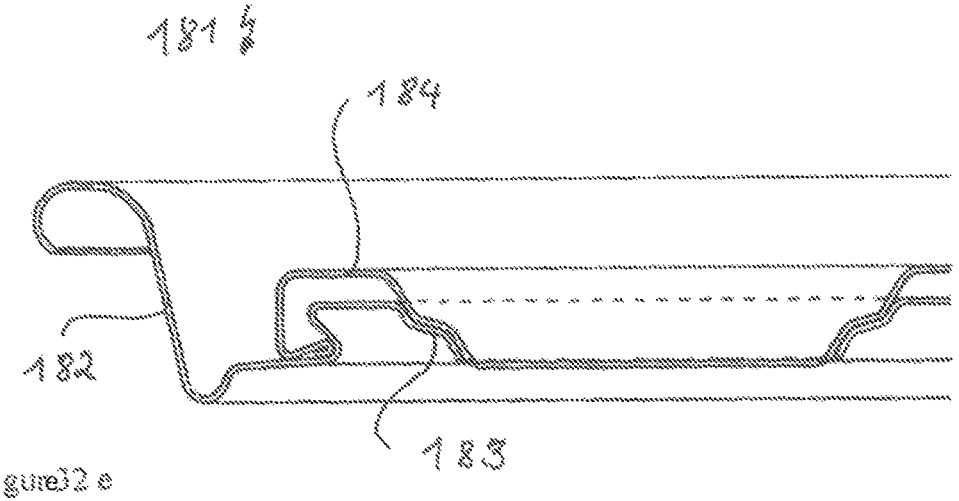

If the fold 183 is attached below the surface of the bottom cover, a larger free space while turning and lifting the top cover component 184 is ensured (see FIG. 32*e*).

Figure 32F:
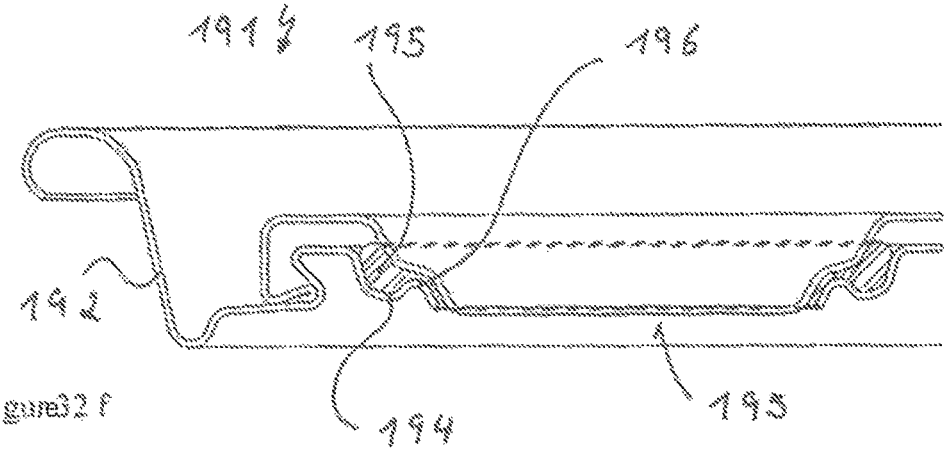

In the variant 191 shown in FIG. 32*f*, the bottom cover component 192 has an opening 193 with a groove 194 in which a seal 195 can be arranged. An additional reinforcement 196 prevents the seal 195 from slipping or sliding.

Figure 32G:
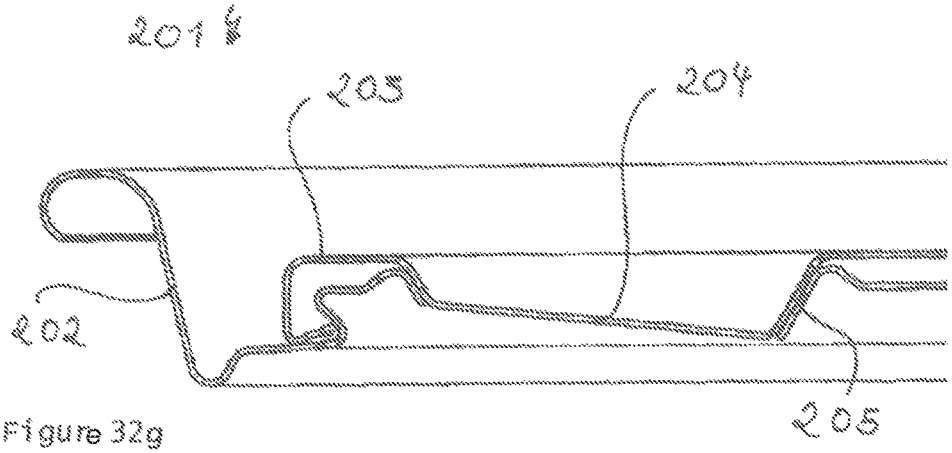

If the bottom can cover 202 and the top can cover 203 are separated by an elevation in the middle (not shown) in the can cover 201 shown in FIG. 32*g*, then the distance of the cover components 202 and 203 to each other towards the exterior decreases with the radius. Additionally, the pressure on the closed cover decreases when it is closed, starting with the radius from the middle (i.e. the pressure in the middle is higher than on the sides). The asymmetrical form of the cone 204 and the fold 205 account for the compensation.

Figure 32H:
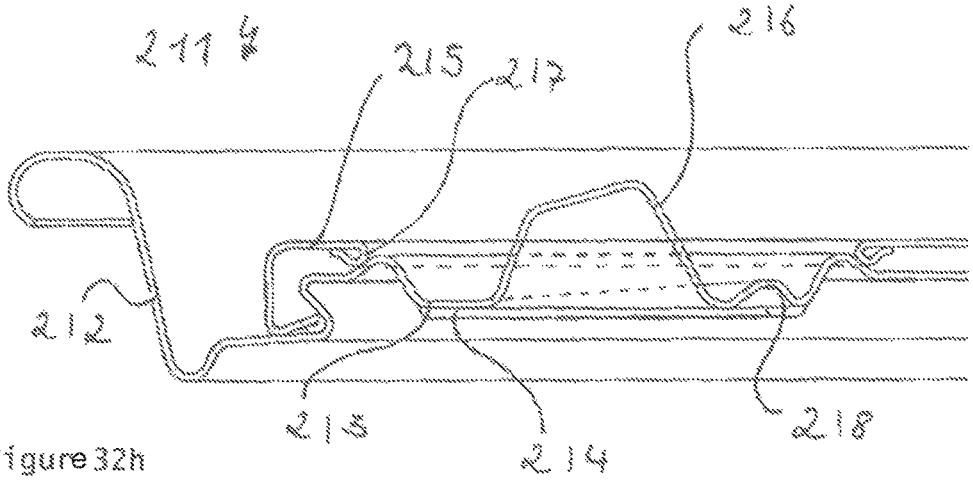

In the structural variant of a can cover 211 shown in FIG. 32*h*, the bottom cover component 212 remains covered with the original cover surface. It has been partly—but not fully—cut, so that material remains standing to serve as hinge for the material that has been broken through. The breaking point can be either a tear line 213 or a cut 214 protected by a seal, in which case the seal breaks as soon as it is opened for the first time.

The cover 211 is opened by turning the top cover component 215 above the elevation 216. Here, the rounded edge 217 located on the top cover component is pushed on and above the elevation 216, as a result of which it is pressed inward and the seal is broken.

Figure 32I:
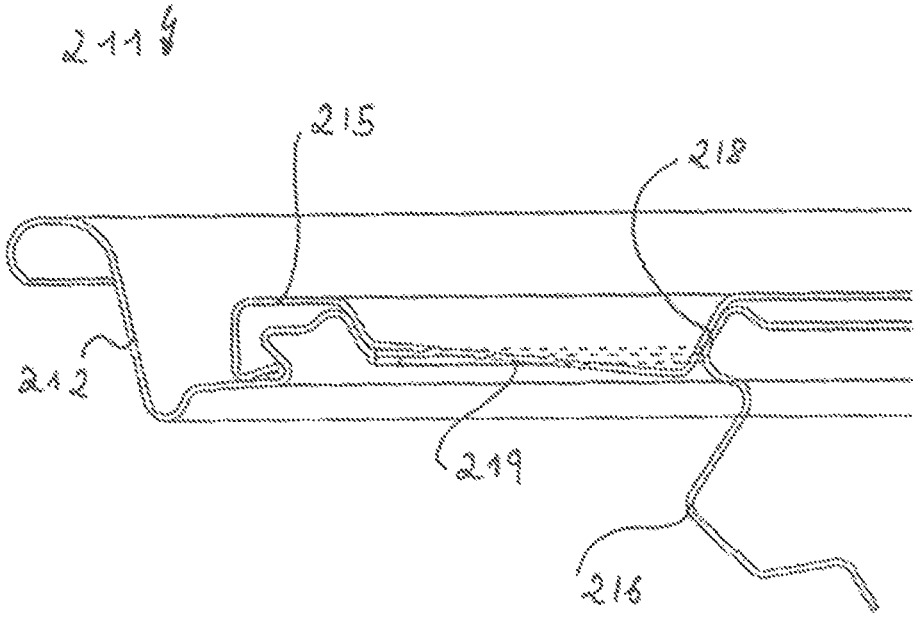
Figure 32J:
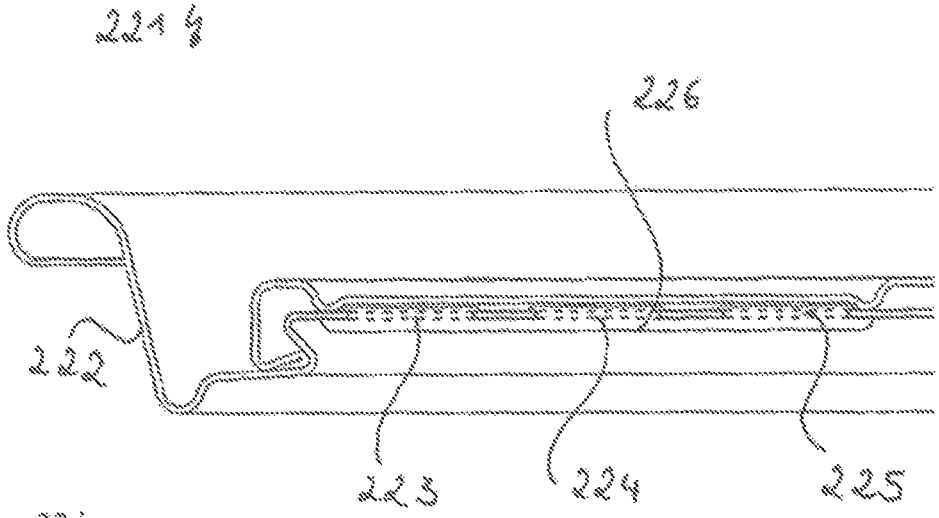

As soon as the connecting piece is broken through by turning the top cover component 215 in the closed position, the piece swings even further back because the second elevation 218 acts together with the lateral surface of the cone 219 of the top cover component 215 (cf. the position of the cover 211 in FIG. 32*i*).

Figure 32K:
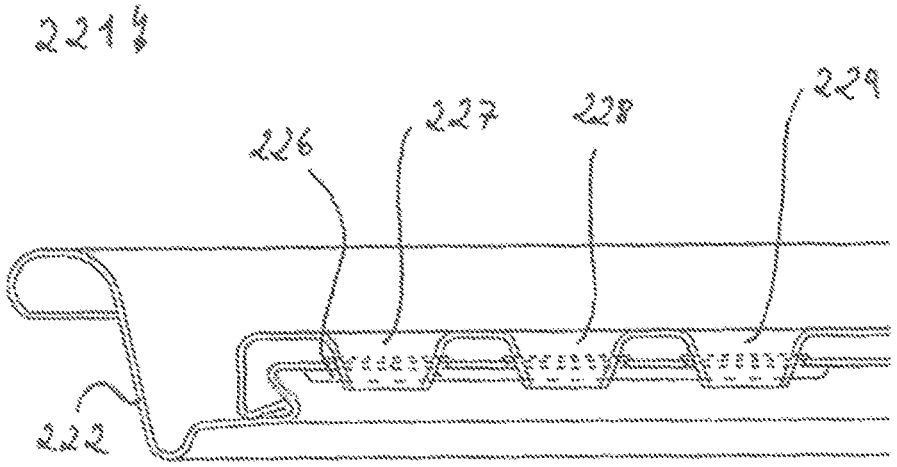

In the structural variant of a can cover 221 shown in closed and open position in FIGS. 31*j* and 32*k*, the bottom cover component 222 has a series of perforations 223, 224 and 225 covered by a soft seal 226. Owing to the small diameter of the openings, the pressure exerted on the seal is sufficiently reduced so that it remains in place without additional fastening. In addition, the cover that will later close the can serves as an additional support for the seal.

The can cover 221 is opened by a few cones with punched holes 227, 228 and 229 (cf. FIG. 32*k*). They have a cutting edge that meets the exposed rubber seal. As soon as these cones 227, 228 and 229 are brought into alignment with the openings 223, 224 and 225, they engage and the cut takes place. Liquid can now flow into the openings created in this fashion. The severed plastic remains hanging on the main seal 226 and is now pushed aside only by the cones 227, 228 and 229. This design prevents insects from reaching the can's interior owing to the small size of the openings.

Figure 32L:
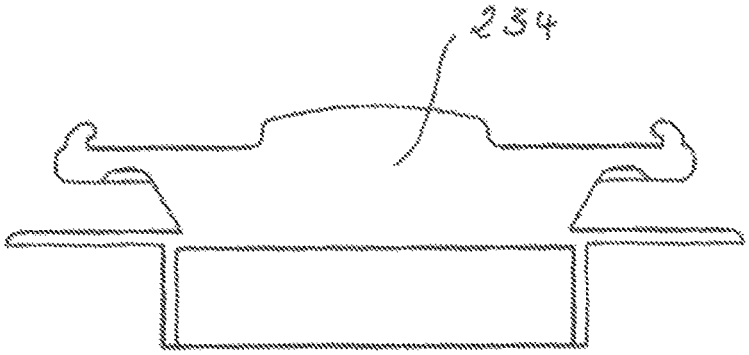
Figure 32M:
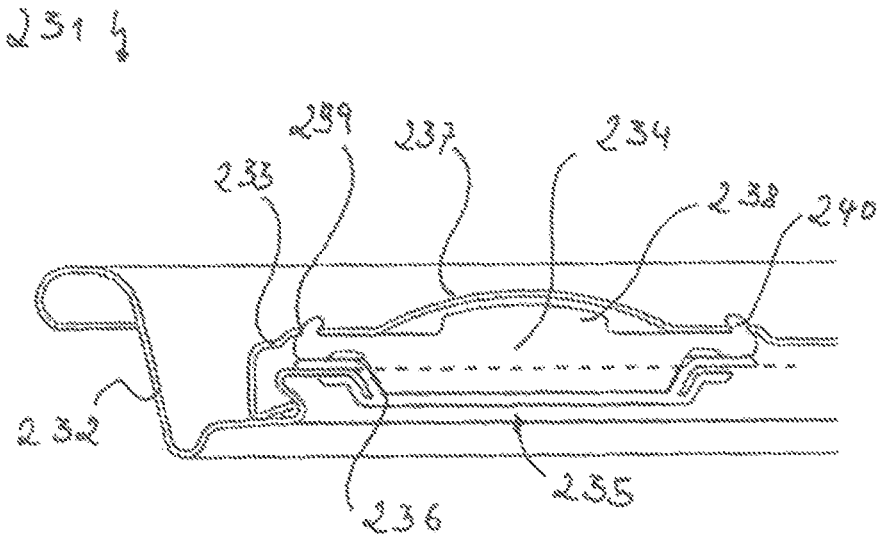

The FIGS. 32*l* and 32*m* show how the seal 234 is used: FIG. 32*l* shows the original form of the seal before it is incorporated into the cover 231. The seal 234 has been shaped in such a way that it can easily fit into the opening 235 located in the bottom cover component 232 so it can be firmly welded later on this spot for achieving the sealing. The seal 234 has a predetermined breaking point that will slide open when the elevation 237 on the top cover component 233 is pressed inward. This pressure is transferred to the seal 234 via the projection 238, opening the former in the process. The top cover component 233 has openings 239 that engage in the tongue-shaped tabs 240 of the seal.

Figure 32N:
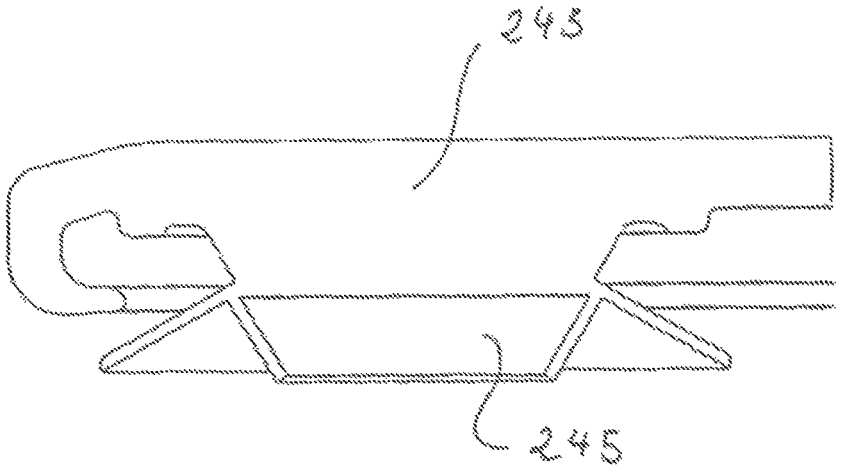
Figure 32O:
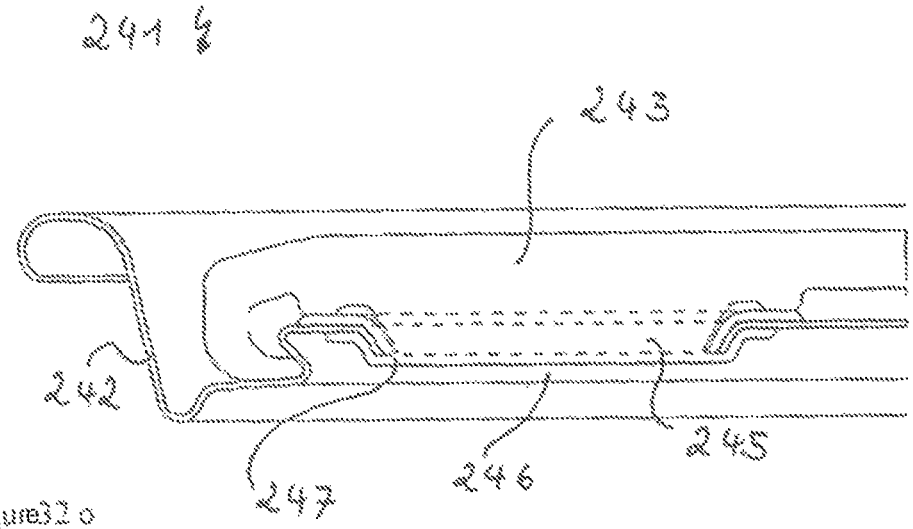

The can cover 241 shown in FIG. 32*o* consists once again of a bottom cover component 242 and a top cover component 243. The seal 244 has been integrated into the top cover component. The top cover component 243 developed from plastic is shown separately in FIG. 32*n*. The original shape of the seal that can be seen in FIG. 32*n* allows a slight adjustment of the sealing component 245 to the shape of the opening 246 in the bottom cover component 242. The seal will be later welded to the bottom cover component 242 to achieve a secure sealing. When the can cover 241 is opened, the part of the seal 245 connected to the bottom cover component 242 remains on this spot, whereas the remaining part separates along the tear line 247 and stays part of the top cover component 243 with the remaining seal part.

Figure 32P:
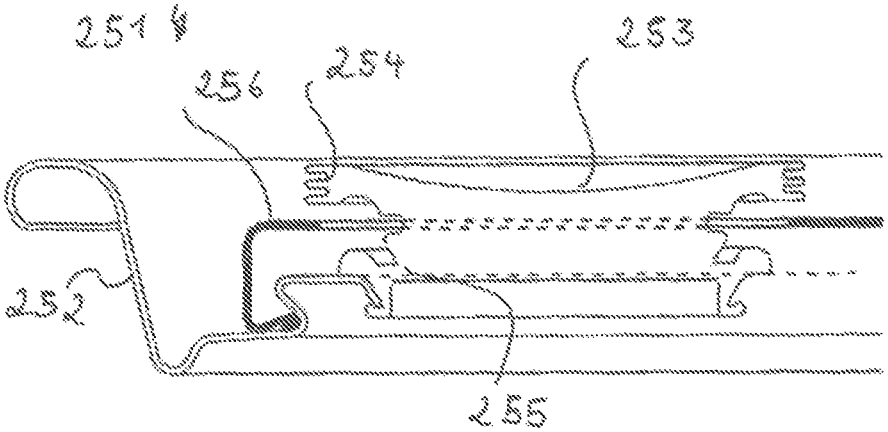

In the can cover 251 of FIG. 32*p*, the plastic seal 253 is surrounded by a rib-shaped structure 254 that engages in a fixed position when it is pressed inward. By pressing the seal inward, the bottom part of the seal 255 breaks off. For closing the can again, the upper part of the seal acts together with the bottom part of the seal.

Figure 32Q:
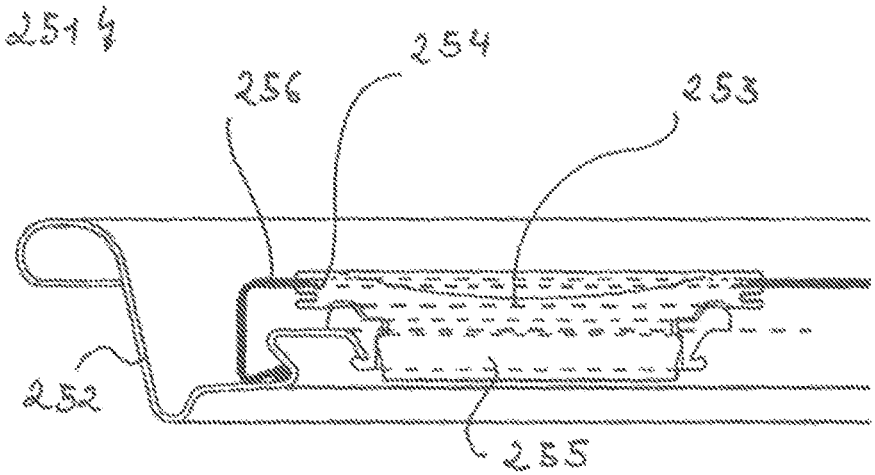

In this context, the seal 253 engages in three positions: On the top cover component 256, on the bottom cover component 252 and finally against itself, when the seal was broken (cf. FIG. 32*q*).

Figure 32R:
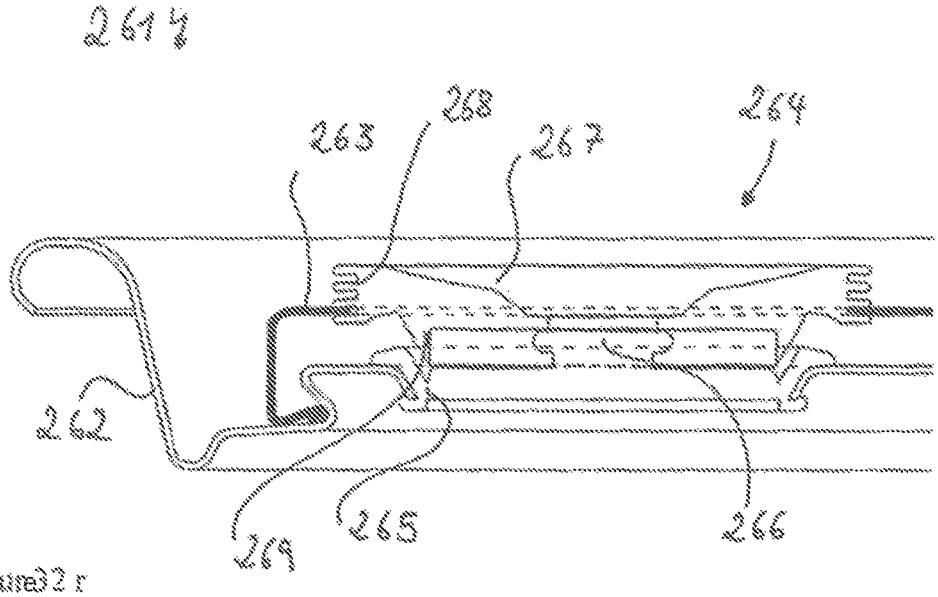
Figure 32S:
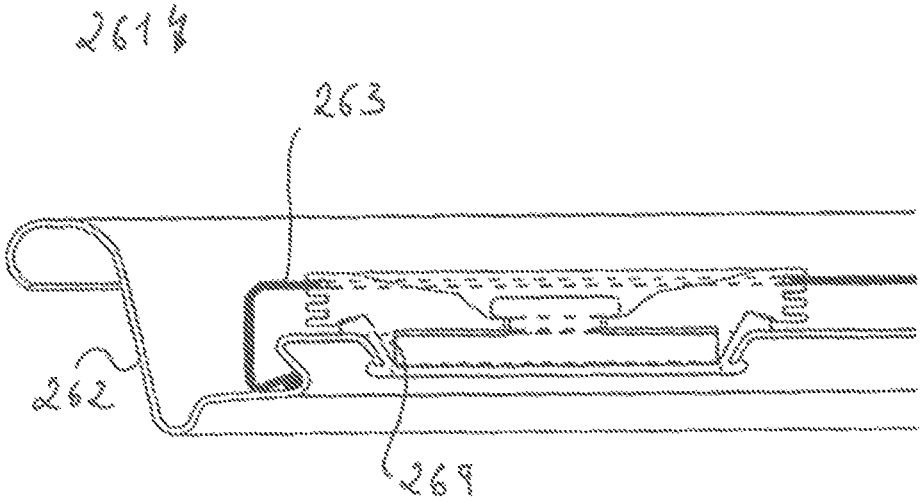

In the structural variant shown in FIG. 32*r*, a seal 264 engages in the opening of the bottom cover component 262. The seal has a tear line 265 and a rod shape 266 and when the seal 264 is pressed inward, the bottom plastic part 267 engages in a rib-shaped structure 268 located on the top cover component 263. It engages farther down in a position that allows a connection of the seal with the plastic part owing to the rod-shaped structure 265. As a result of this movement, the cutting tip 269 of the plastic part breaks through the seal 264. As can be seen in FIG. 32*r*, the conical cutting tip 269 simultaneously protects the cutting area of the seal 264 and also the seal 264 from the cover surface.

As shown in FIG. 33, there are various structural variants for guiding the top cover component on the bottom one. In this connection, FIG. 33*a* shows a three-dimensional view of the bottom cover component 272 and the top cover component 273 (both of them seen in cross section in FIG. 33*b* put together as cover 271). The bottom cover component 272 has one single ramp 274 projecting upward, located in the middle of the bottom cover component 272. When the top cover component 273 is turned, the ramp 274 presses against the corner 275 of the top cover component 273 and lifts it. A 180° turn brings the cover components 273 and 272 back to their original position.

Figure 33A:
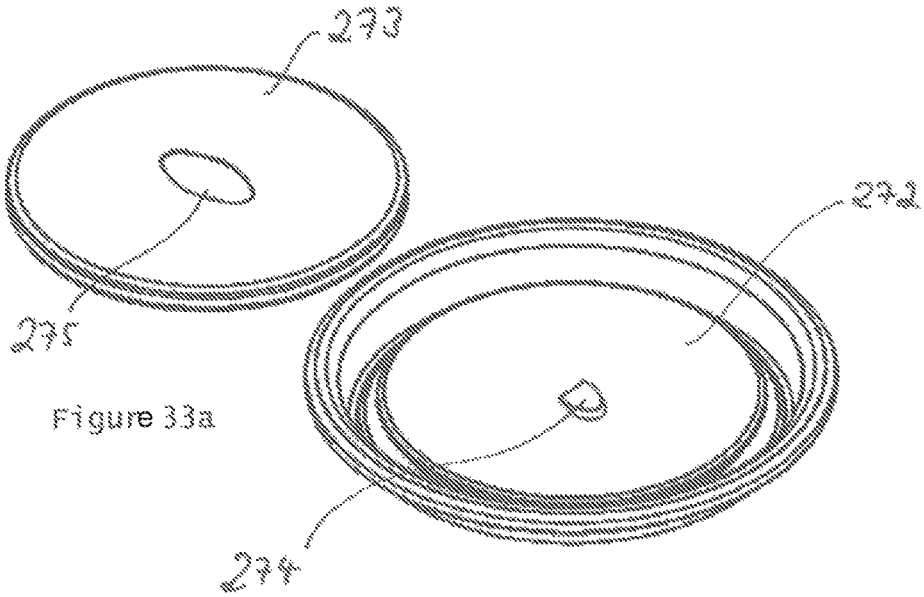
FIGS. 33*a* through 33*i* are views of possible designs of the guide from the top cover component to the bottom cover component.
Figure 33B:
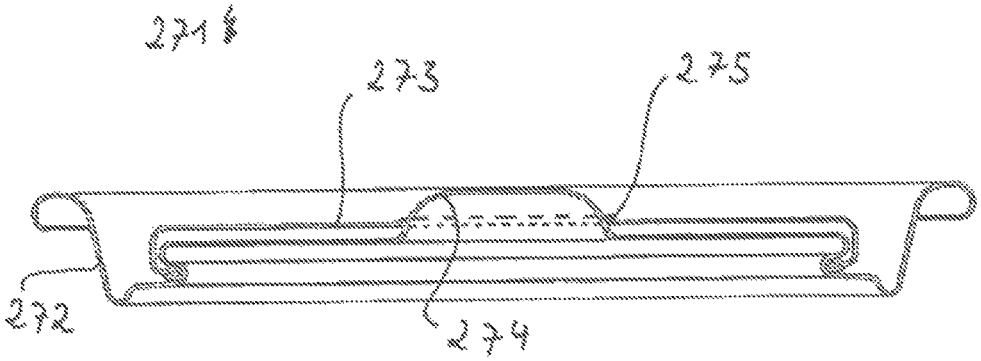
Figure 33C:
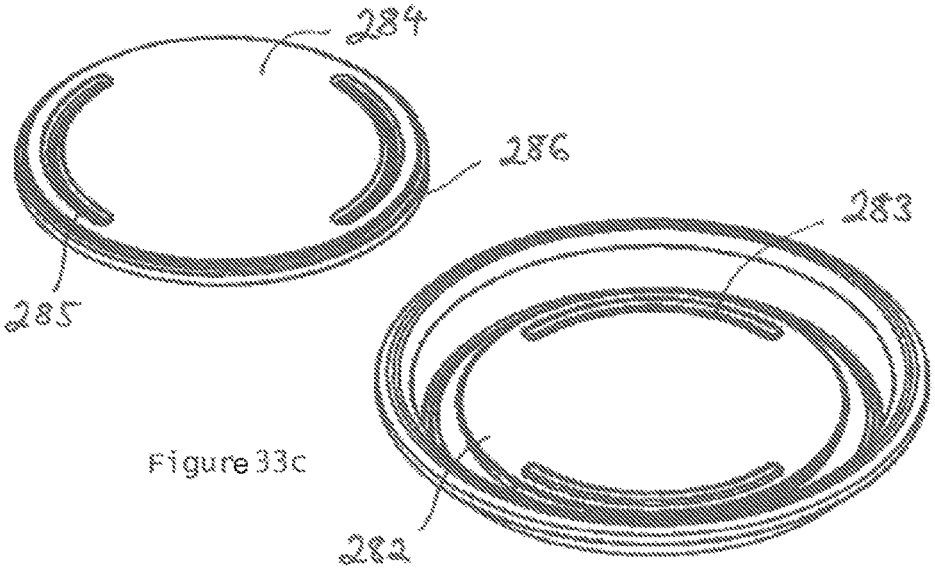
Figure 33D:
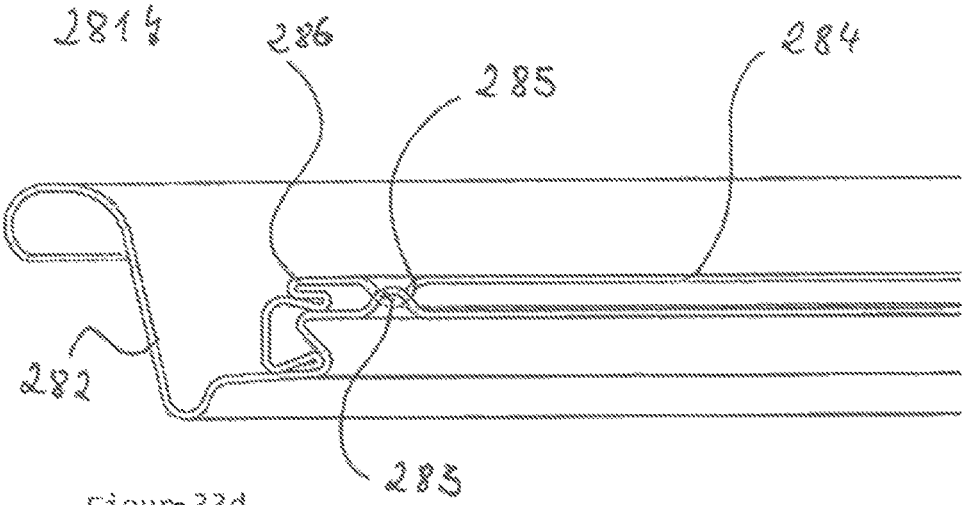

In the structural variant shown in FIGS. 33*c* and 33*d*, the bottom cover component 282 has at least one ramp 283 pointing upward, attached on the outer perimeter of the cover. The top cover component 284, on the other hand, has a ramp 285 that points downward. When the top cover component 284 is turned on the bottom cover component, the two elevations located between them come into contact and the covers are separated from each other. The fold 286 of the top cover component 284 prevents permanent damage through lifting and facilitates the lifting in this area.

Figure 33E:
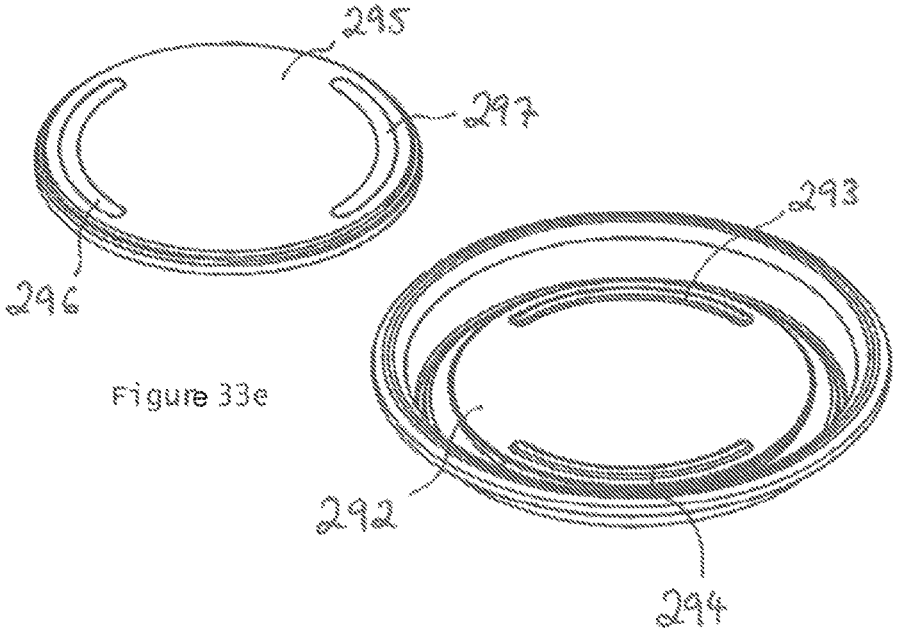
Figure 33F:
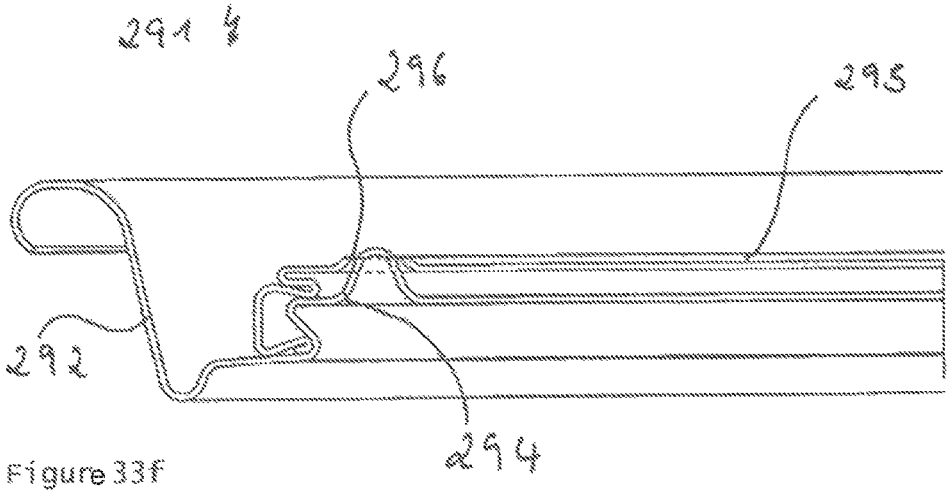

In the structural variant 291 shown in FIGS. 33*e* and 33*f*, the bottom component 292 has once again two ramps 293 and 294. This time, however, the upper component 295 has a different design with openings 296 and 297 in the corresponding spots of the ramps. When the top cover component 295 is twisted in such a way that the openings no longer come to rest above the ramps, the two cover components are separated from one another.

Figure 33G:
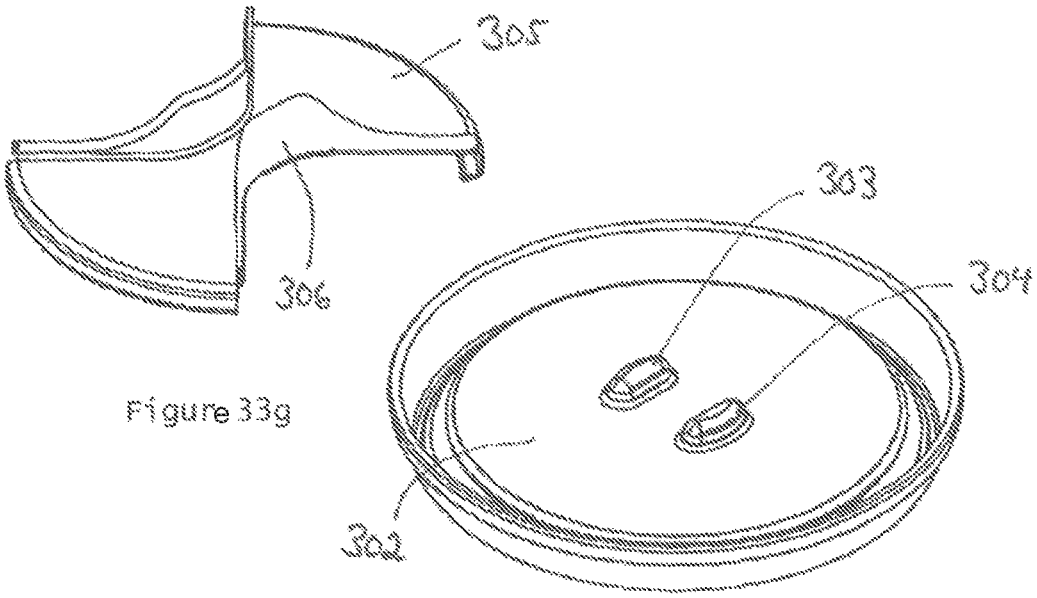
Figure 33H:
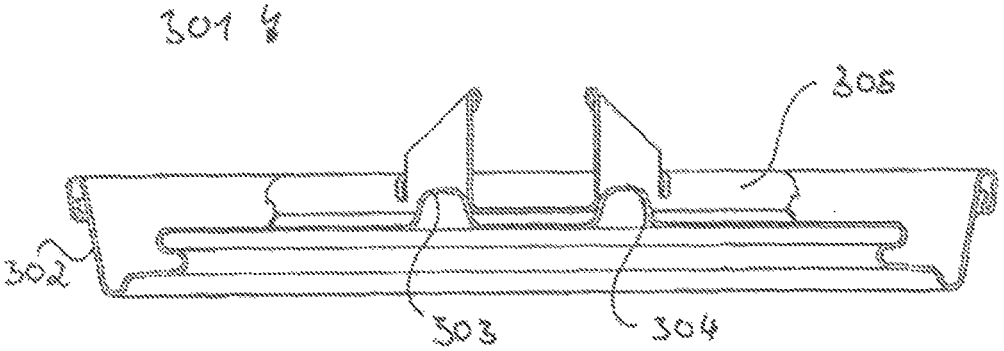

The structural variant 301 shown in FIGS. 33*g* and 33*h* has two ramps 303 and 304 in the bottom cover component 302. These ramps press against the open side 306 of the top cover component 305 when the latter is turned and separate both cover components in this fashion by lifting.

Figure 33I:
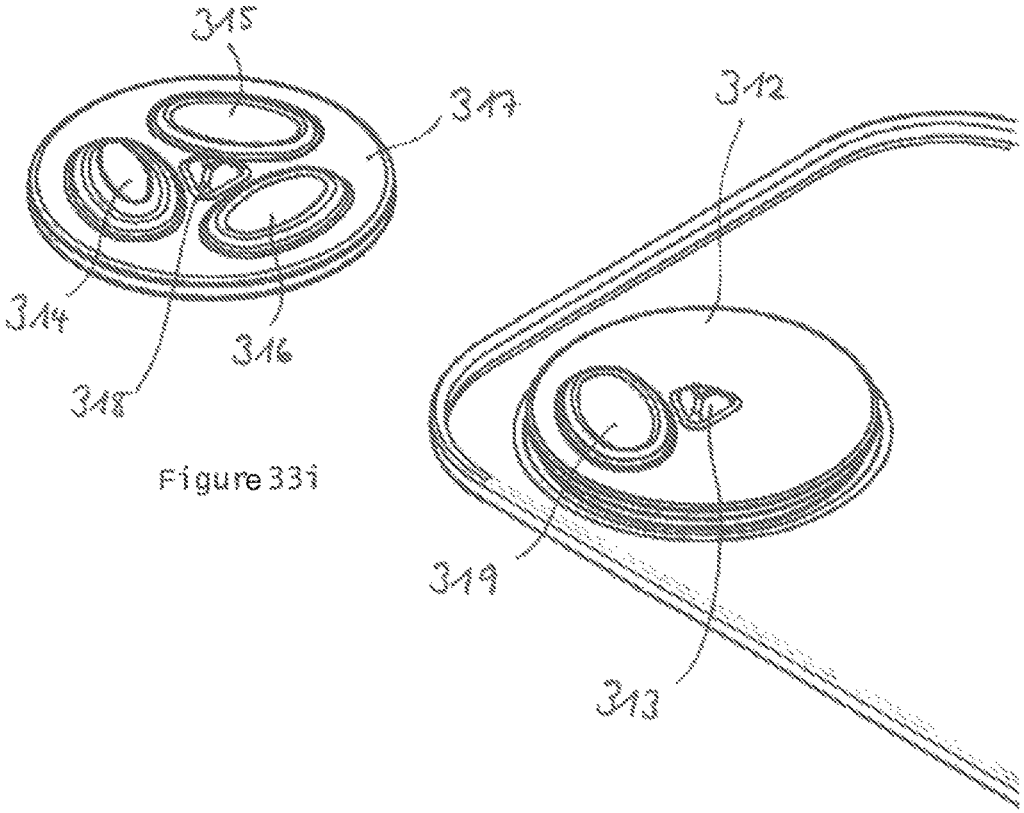

The bottom cover component 312 of the structural variant shown in FIG. 33*i* has a three-sided elevation 313. The top cover component 317 has a smaller opening 314, a larger opening 315 and a closed lid 316 as well as an elevation 318. With the help of the three-sided elevations 313, 318, every one of these functional elements can be lined up by turning the top cover component 317 with the opening 319 located in the bottom cover component 312.

Figure 34A:
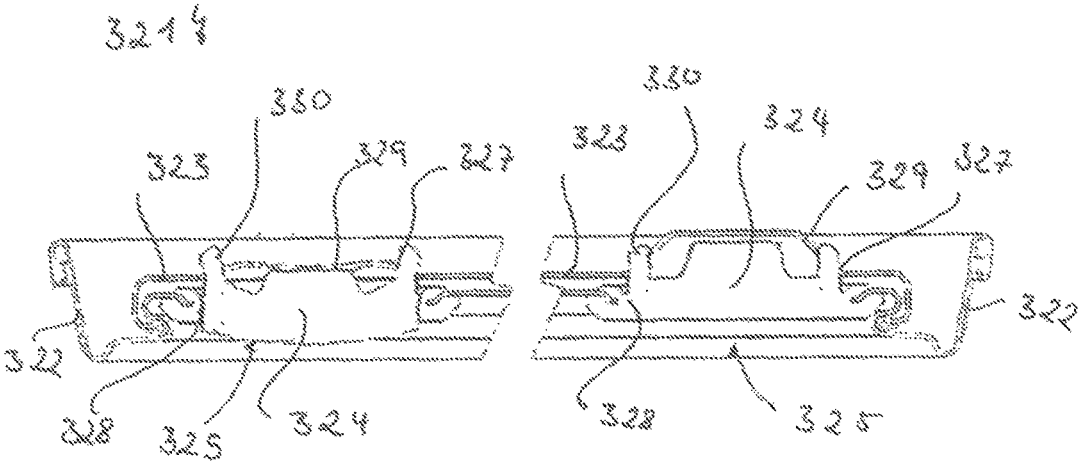
FIGS. 34*a* through 34*o* are views of the various closure variants both in the open and closed position.

In the structural variant 321 of FIG. 34*a* (left after opening, right before), a hard plastic seal 324 has been attached on the opening 325 of the bottom cover component 322. The seal 324 has a tear line 328. The top cover component 323 has an elevation 329 that has holes 327 with tongues, which act together with the toothed tabs 330 when the elevation 329 is pressed inward. As a result of this, the seal is extended in such a way that it tears along the predetermined tear line 328. The torn seal remains attached to the top component 323 and serves as closure so the can be closed once again after opening.

Figure 34B:
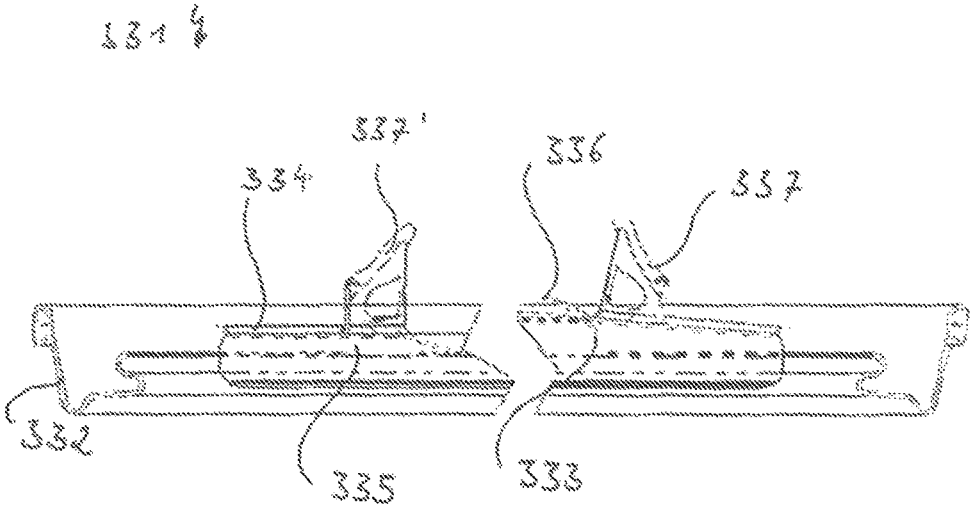

In the structural variant 331 of FIG. 34*b* (right after opening, left before), the top cover component 334 has a middle section that acts together with the elevation 333 in the bottom cover component 332. If the top cover component is turned above the lifting ramps 335, the elevation 336 will jump from convex to concave. When that happens, the two flaps 337 and 337" will fold slightly outward and hold the top cover component 334 upward. In this upper position, the can may only be closed, but not sealed. In order to seal the can, the two flaps 337 and 337" are pressed together to their original position, whereupon the top cover component 334 engages.

Figure 34C:
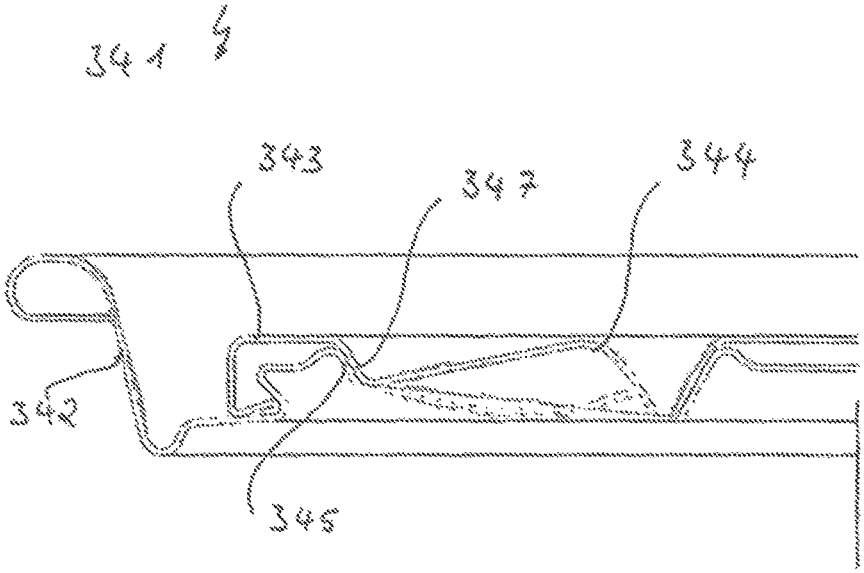

In the structural variant 341 shown in FIG. 34*c*, the cone 347 of the top cover component 343 has an asymmetrical form with an elevation 344. The cone 347 is welded to the wall 345 by welding a plastic layer of a hybrid coating material made of plastic and metal. If the asymmetrical elevation 344 is pressed from concave to convex, the welded sealing opens and allows gas to escape. This causes the top cover component 343 and the bottom cover component 342 to separate sufficiently, thus facilitating the turning of the top cover component 343.

Figure 34D:
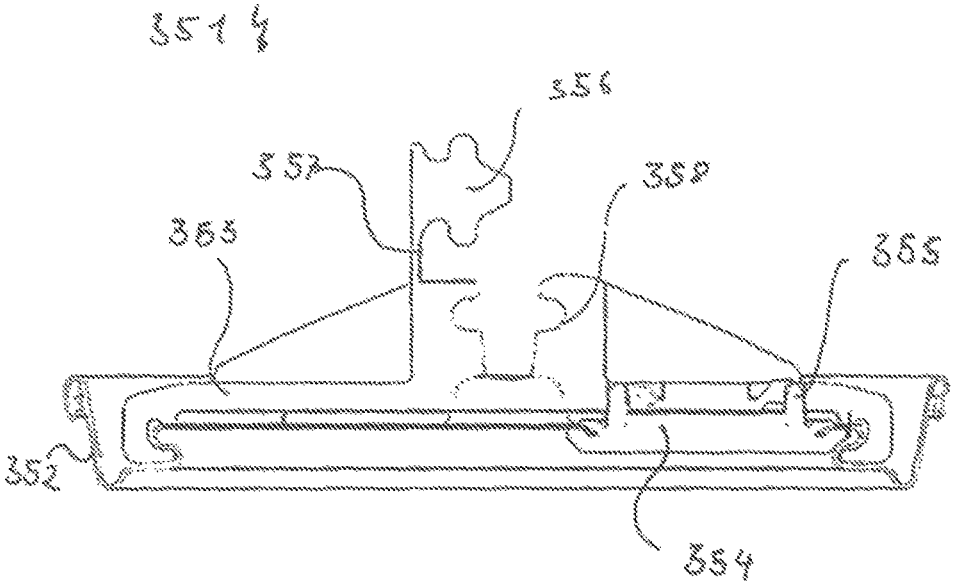
Figure 34E:
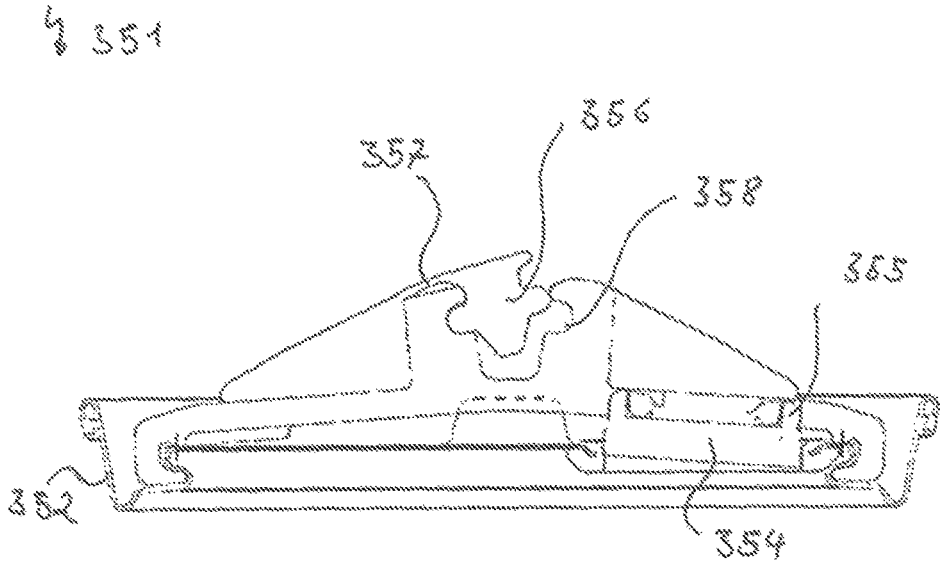

In the structural variant 351 (shown in an open position in FIG. 34*d* and in a closed position in FIG. 34*e*), a plastic seal 354 is attached on the bottom cover component 352. The former has an engagement device 355 that will subsequently act together with the top cover component 353. The top cover component 353 has an engagement device 356 connected to the top cover component 353 with a tab 357. When the engagement component 356 is pressed into the guide 358, the top cover component 353 is lifted, thereby breaking through the seal 354 on the bottom cover component 352 (cf. FIG. 34*e*).

Figure 34F:
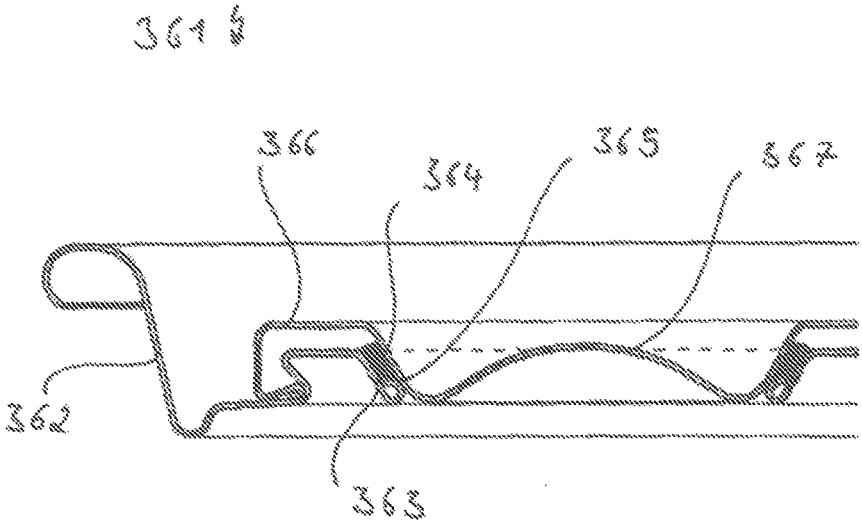
Figure 34G:
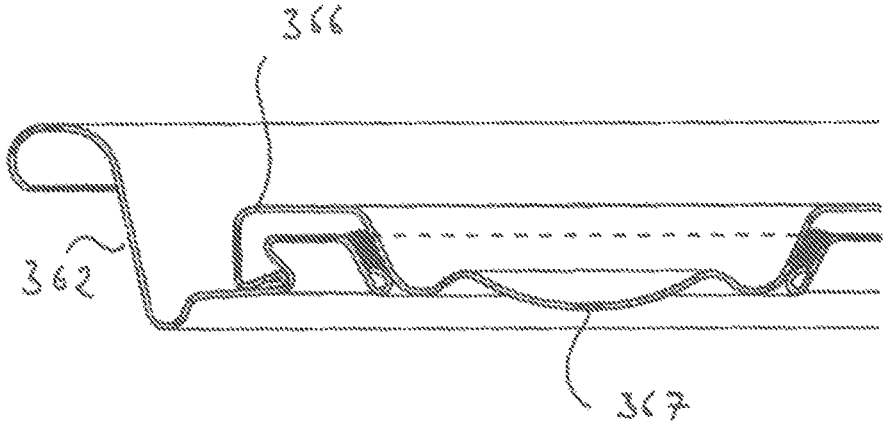

In the structural variant of FIGS. 34*f* and 34*g*, the bottom cover component 362 has an opening 363 strongly bent outward for securing the seal 364. The connection between the cone 365 of the top cover component 366 and the seal 364 is interrupted when the elevation 367 is pressed, going from the concave position in FIG. 34*f* to the convex position shown in FIG. 34*g*.

Figure 34H:
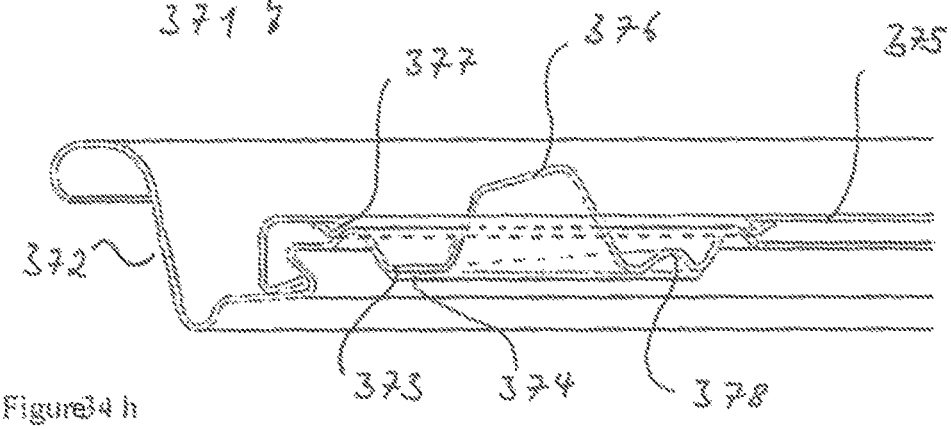
Figure 34I:
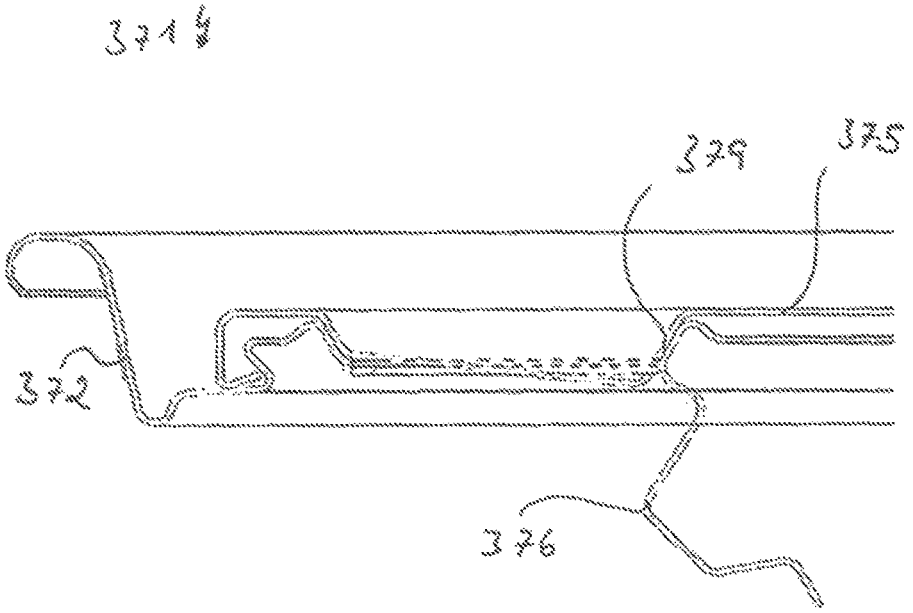

In the structural variant of a can cover 371 shown in FIGS. 34*h* and 34*i*, the bottom cover component 372 remains covered with the original cover surface. The area lying underneath the lateral wall has a tear line 373 or is partly cut 374, but not fully separated. Thus, there remains material that can serve as hinge for the broken-through material. The cover 371 is opened by turning the top cover component 375 above the elevation 376, in which case the edge 377 in the upper cover component is pushed on and above the elevation 376.

In the closed position (cf. FIG. 34*i*), the cover piece that was broken inward swings even farther back because the second elevation 378 acts together with the lateral surface of the cone 379 of the top cover component 375.

Figure 34J:
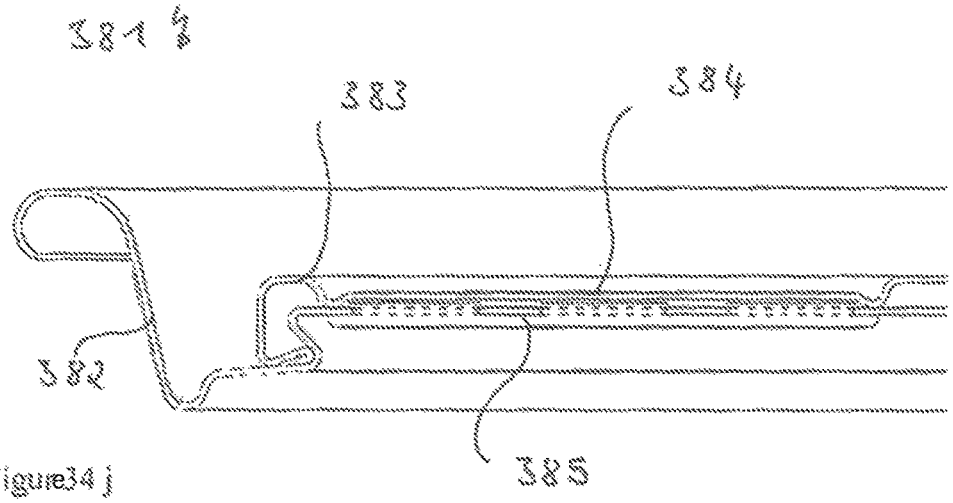
Figure 34K:
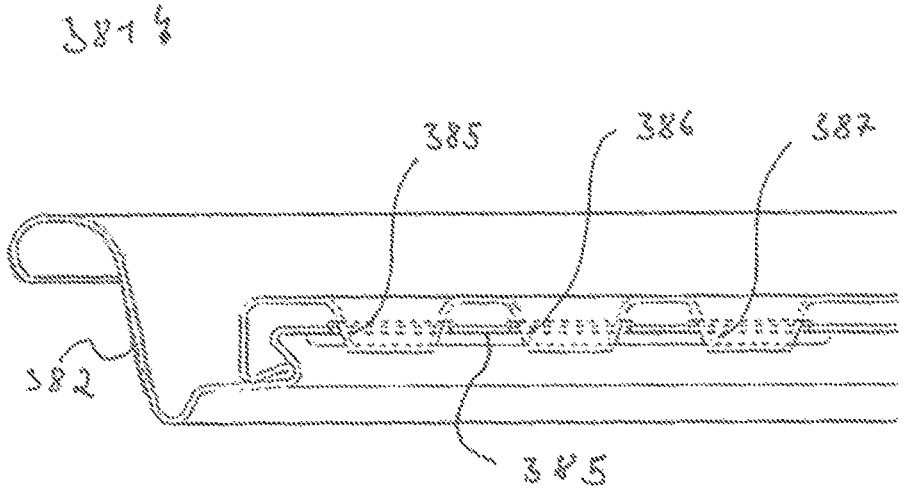

The inner ring 384 of the top cover component 383 exerts sufficient pressure on the seal 385 to keep the can cover 381 shown in FIGS. 34*j* and 34*k* tightly closed. In addition, the inner ring 384 protects the elastic seal from expanding under extreme pressures after all. Once the cover 381 has been opened, the opened wall of the cones 385, 386, 387 presses so tightly on the seal 385, that no liquid can reach between them.

Figure 34L:
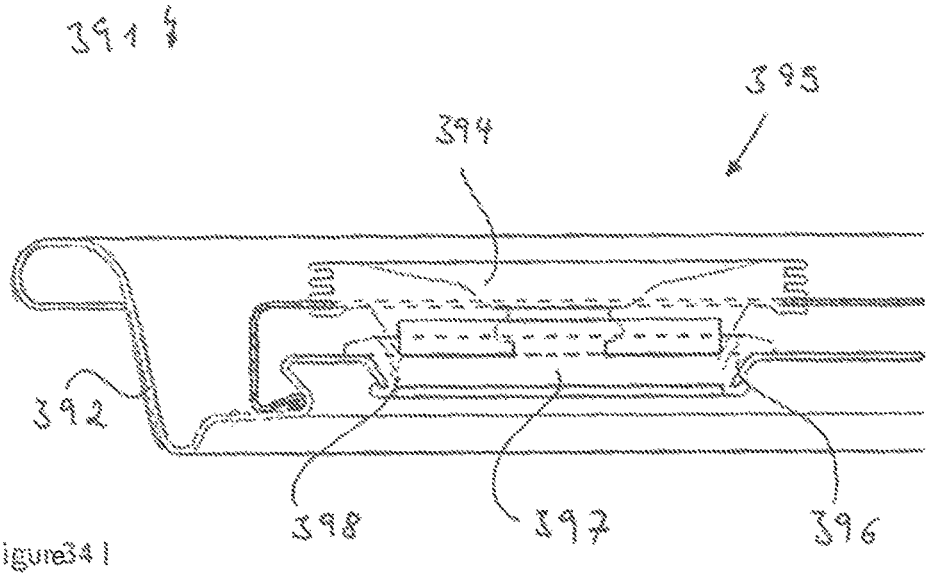
Figure 34M:
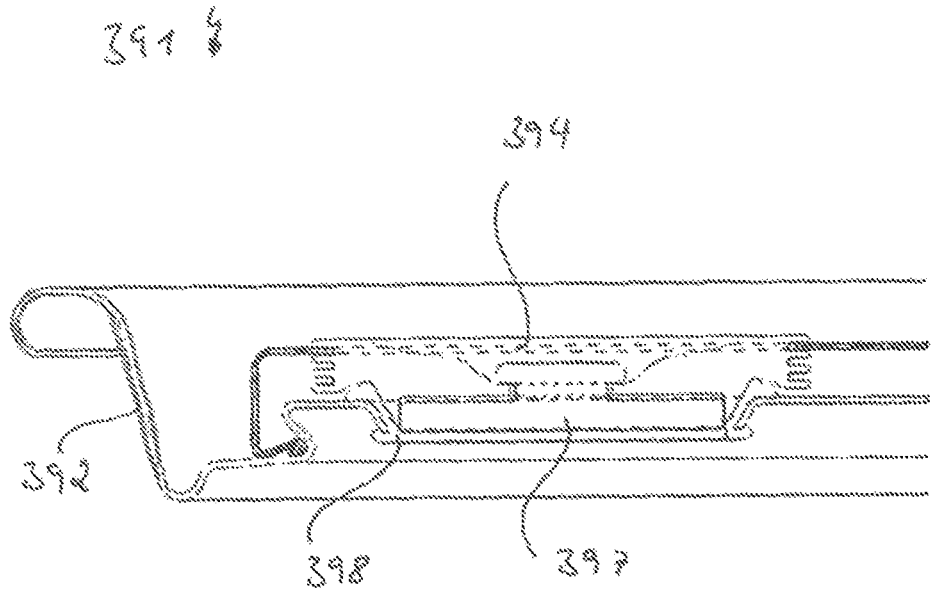

In the variant shown in FIGS. 34*l* and 34*m*, the locking position of the top component 394 of the seal 395 exerts, when pressed, a lateral pressure on the wall 396 of the opening edge, thereby creating a sealing. At the same time, the top section 394 of the seal also severs the actual seal along the predetermined tear line 398. The broken off section 397 of the seal integrates itself into the top component 394.

Figure 34N:
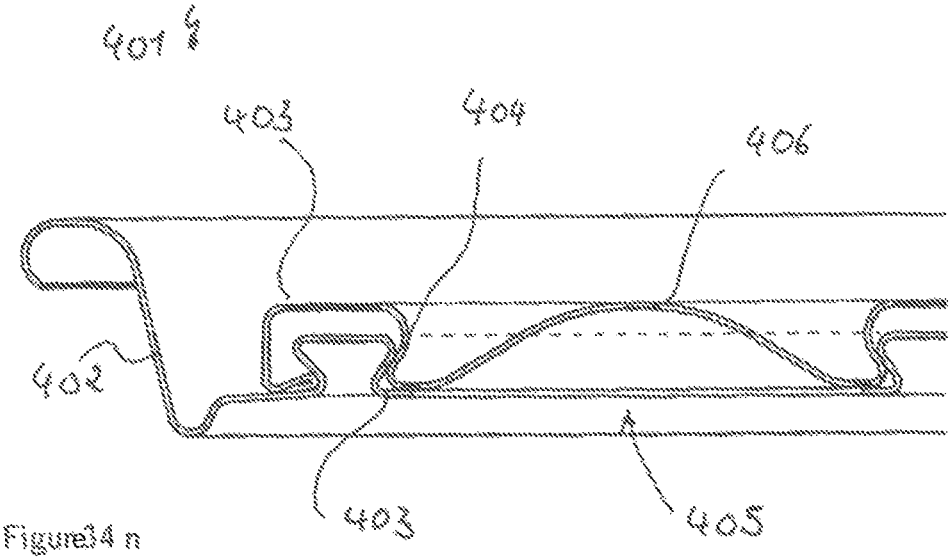
Figure 34O:
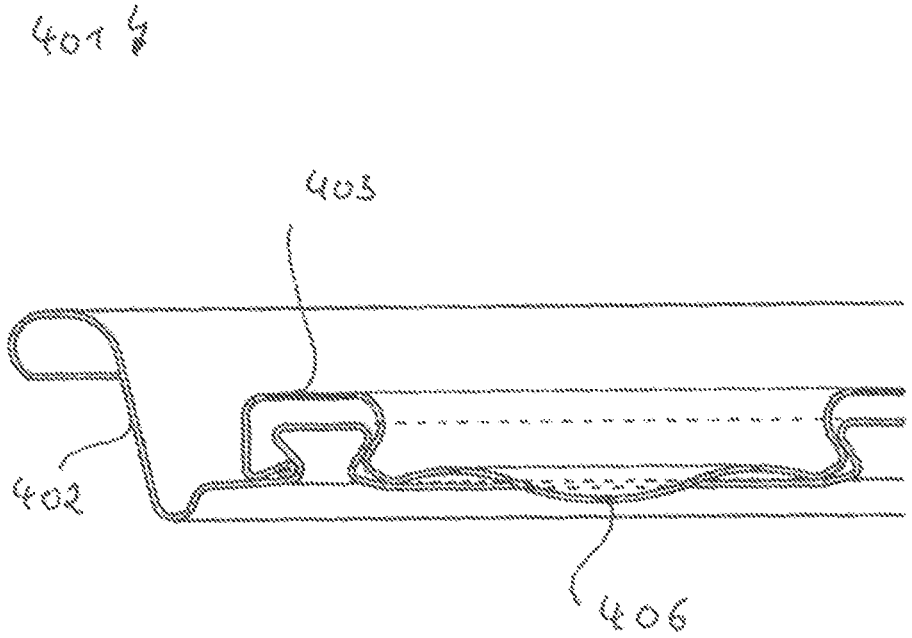

In the structural variant of a cover 401 (cf. FIGS. 34*n* and 34*o*), the bottom cover component 402 has an edge 403 bent inwards. The top cover component 403, in turn, has an inverse cone 404 that is somewhat bigger than the inner edge of the opening 405. Owing to the larger circumference, the top cover component 403 engages and the can is tightly closed. The utilization of a plastic-metal coating material can prevent the two metallic cover components from touching. The can is opened by pressing the elevation 406 inward from its concave (FIG. 34*n*) to a convex form (FIG. 34*o*).

Modifications and variations can be made to the embodiments illustrated or described herein without departing from the scope and spirit of the invention as set forth in the appended claims.

What is claimed is:

1. A cover for opening and closing beverage cans, comprising:

a top cover component with an opening therein and a radially outermost end;

a bottom cover component with an opening therein, said top cover component rotatably mounted on said bottom cover component, wherein said openings in said top cover component and said bottom cover component align to define a through-hole through said cover by rotation of said top cover component relative to said bottom cover component, said through hole closed by further rotation of said top cover component relative to said bottom cover component;

said bottom cover component comprising an at least partially circular and concave fastening groove defined on a top side thereof, said fastening groove having an open end oriented radially outward and a closed end extending radially inward relative to an outer radius of said bottom cover component;

said top cover component comprising a spring hook with a distal end disposed radially inward of said radially outermost end of said top cover component, said fastening groove disposed radially inward of said distal end such that said distal end extends radially inward into said open end of said fastening groove and engages against said bottom cover component at said closed end within said fastening groove, said spring hook moving within said fastening groove when said top cover component is rotated relative to said bottom cover component; and wherein the top cover component and the bottom cover component are only connected with each other via said spring hook moving within said fastening groove.

2. The cover as in claim 1, wherein said fastening groove is disposed below a level of said opening in said bottom cover component and above a lowermost level of said bottom cover component.

3. The cover as in claim 1, wherein said bottom cover component comprises an elevation that engages against and lifts said top cover component relative to said bottom cover component when said top cover component is rotated relative to said bottom cover component.

4. The cover as in claim 1, wherein said top cover component and said bottom cover component are made of one or more of aluminum, plastic, or sheet metal.

5. The cover as in claim 1, wherein said top cover component comprises an open recess.

6. The cover as in claim 5, wherein said recess is defined as a circular segment in said top cover component.

7. The cover as in claim 1, wherein said top cover component comprises two radially opposite open circular segment recesses defined therein, and two radially opposite circular material segments, said spring hook defined at radial edges of said two circular material segments.

8. The cover as in claim 7, wherein said top cover component further comprises wings in a central area between said radially opposite circular material segments, said wings configured for grasping and rotating said top cover component.

9. The cover as in claim 1, further comprising a sealing surface around said opening in said bottom cover component, said sealing surface pressed directly against said top cover component in a rotated position of said top cover component that closes said through-hole.

10. The cover as in claim 9, wherein said bottom cover component extends in a cover level below said top cover component, said sealing surface disposed below said cover level.

11. The cover as in claim 10, wherein said sealing surface comprises a sealing edge that is angled radially inward and downward.

12. The cover as in claim 1, further comprising a breakable seal configured between said aligned openings in said top and bottom cover components.

13. The cover as in claim 12, wherein said breakable seal comprises a seal member that engages into said opening in said bottom cover component.

14. The cover as in claim 13, wherein said seal member is attached to said top cover component.

15. The cover as in claim 1, wherein at least one of said top or bottom cover components is made from a hybrid laminate material having a plastic layer.

16. The cover as in claim 15, wherein each of said top and bottom cover components are made from the hybrid laminate material, wherein the respective plastic layer of said top and bottom cover components are facing.

17. The cover as in claim 1, wherein said opening in said bottom cover component comprises an angled inner edge, said top cover component comprising a cone-like projection that engages against said angled inner edge in the closed rotational position of said top cover component relative to said bottom cover component.

18. The cover as in claim 17, wherein said top cover component comprises a raised elevation section, said cone-like projection defined in and extending downwardly from said elevation section such that a sealed engagement between said cone-like projection and said angled inner edge of lies in a plane below said elevation section.

19. A beverage can, comprising:

a cylindrical body;

a cover mounted onto said body, said cover further comprising:

a top cover component with an opening therein and a radially outermost end;

a bottom cover component with an opening therein, said top cover component rotatably mounted on said bottom cover component, wherein said openings in said top cover component and said bottom cover component align to define a through-hole through said cover by rotation of said top cover component relative to said bottom cover component, said through hole closed by further rotation of said top cover component relative to said bottom cover component;

said bottom cover component comprising an at least partially circular and concave fastening groove defined on a top side thereof, said fastening groove having an open end oriented radially outward and a closed end extending radially inward relative to an outer radius of said bottom cover component;

said top cover component comprising a spring hook with a distal end disposed radially inward of said radially outermost end of said top cover component, said fastening groove disposed radially inward of said distal end such that said distal end extends radially inward into said open end of said fastening groove and engages against said bottom cover component at said closed end within said fastening groove, said spring hook moving within said fastening groove when said top cover component is rotated relative to said bottom cover component; and wherein the top cover component and the bottom cover component are only connected with each other via said spring hook moving within said fastening groove.

* * * * *